US007384282B2

(12) United States Patent
Tomita et al.

(10) Patent No.: US 7,384,282 B2
(45) Date of Patent: Jun. 10, 2008

(54) LOCK ASSEMBLY FOR ATTACHMENT TO A LAN-CABLE CONNECTOR

(75) Inventors: Shinji Tomita, Yokosuka (JP); Noboru Tuchiya, Yokohama (JP); Norihiro Suzuki, Asaka (JP)

(73) Assignee: Lintec 21 Co., Ltd., Yokosuka-shi (JP)

( * ) Notice: Subject to any disclaimer, the term of this patent is extended or adjusted under 35 U.S.C. 154(b) by 0 days.

(21) Appl. No.: 10/563,245

(22) PCT Filed: Jun. 30, 2004

(86) PCT No.: PCT/JP2004/009597

§ 371 (c)(1),
(2), (4) Date: Jun. 2, 2006

(87) PCT Pub. No.: WO2005/004293

PCT Pub. Date: Jan. 13, 2005

(65) Prior Publication Data

US 2007/0105416 A1 May 10, 2007

(30) Foreign Application Priority Data

| | | |
|---|---|---|
| Jul. 1, 2003 | (JP) | 2003-270437 |
| Jul. 1, 2003 | (JP) | 2003-288241 |
| Aug. 28, 2003 | (JP) | 2003-271575 |
| Aug. 28, 2003 | (JP) | 2003-345010 |
| Oct. 22, 2003 | (JP) | 2003-272684 |
| Oct. 22, 2003 | (JP) | 2003-394715 |

(51) Int. Cl.
*H01R 13/44* (2006.01)

(52) U.S. Cl. ..... 439/133; 439/373

(58) Field of Classification Search ..... 439/133, 439/135, 304, 373
See application file for complete search history.

(56) References Cited

U.S. PATENT DOCUMENTS

| | | | | |
|---|---|---|---|---|
| 4,311,883 | A * | 1/1982 | Kidney | 379/443 |
| 4,740,168 | A | 4/1988 | Carney et al. | |
| 4,846,708 | A | 7/1989 | Marson et al. | |
| 4,911,646 | A | 3/1990 | Marson et al. | |
| 6,012,941 | A | 1/2000 | Burdenko et al. | |
| 6,485,316 | B1 * | 11/2002 | Chen | 439/135 |
| 6,848,926 | B2 * | 2/2005 | Ling et al. | 439/304 |
| 7,140,889 | B1 * | 11/2006 | Shah et al. | 439/133 |
| 2003/0224637 | A1 * | 12/2003 | Ling | 439/133 |

FOREIGN PATENT DOCUMENTS

| | | |
|---|---|---|
| GB | 2204190 A * | 11/1988 |
| JP | 59-136175 | 9/1984 |
| JP | 8-64304 | 3/1996 |
| JP | 11-26086 | 1/1999 |
| JP | 2001-266993 | 9/2001 |

* cited by examiner

*Primary Examiner*—Michael C. Zarroli
(74) *Attorney, Agent, or Firm*—Westerman, Hattori, Daniels & Adrian, LLP.

(57) ABSTRACT

Disclosed is a lock assembly 10 adapted to be detachably attached to a LAN-cable connector 106 which is integrally fixed to a LAN cable 100 and adapted to be removably inserted into a socket 102 of a computer 102 and latched at an inserted position thereof. The lock assembly is operable, when attached to the LAN-cable connector, to allow the LAN-cable connector 106 after being inserted into the socket 104 to be locked at the inserted position, and, when detached from the LAN-cable connector 106, to allow the LAN-cable connector 106 to be removed from the socket 102.

23 Claims, 36 Drawing Sheets

LOCK ASSEMBLY FOR ATTACHMENT TO A LAN-CABLE CONNECTOR

TECHNICAL FIELD

The present invention relates to a lock assembly for preventing theft of a computer, using a connector which is integrally fixed to an end of a LAN cable for a local area network or an intranet and adapted to be removably inserted into a socket of a computer (hereinafter referred to simply as "PC") or into a socket of a hub for an intranet.

BACKGROUND ART

Heretofore, as measures against theft of a PC, there has been known a technique of mechanically coupling the PC to a stationary member (e.g. desk) using a coupling cord, such as a wire, to fasten the PC to its setup location in a non-removal manner. Generally, an existing commercially-available PC is not formed with a hole for penetratingly receiving the coupling cord. Therefore, before using the coupling cord, it is necessary to prepare a hook member formed with a hole for penetratingly receiving the coupling cord, and bonding the hook member onto a surface of the PC. The hook member bonded on the PC surface is extremely hard to be detached therefrom. If a user attempts to forcedly detach the hook member, a housing of the PC is likely to be damaged. Thus, there is the need for providing an improved PC antitheft device.

In an intranet configuration designed to connect a plurality of PCs to a server via a hub, each LAN cable is designed to be mechanically connected to the hub in a detachable manner. This causes an undesirable situation where the LAN cable is detached from the hub, and the PC mechanically connected to the LAN cable is moved out together with the LAN cable. Thus, in the intranet configuration, even if the PC is fastened to its setup location using the above coupling cord, it is difficult to obtain a sufficient antitheft effect.

A LAN cable for a local area network or an intranet has a connector integrally fixed to an end thereof and adapted to be removably inserted into a socket of a PC or into a socket of a hub. However, the conventional connector is not designed to sufficiently prevent occurrence of troubles, system failures, to be caused by intentionally or erroneously pulling out or removing a LAN-cable from the hub or by intentionally or erroneously inserting a wrong LAN-cable into a socket of the hub.

Further, when a PC-maintenance staff checks a state of PC antitheft or a state of connection between a PC and a hub, it is essential to distinguish a LAN-cable of the PC to be checked (target PC). Heretofore, the PC-maintenance staff had no choice but to distinguish the LAN-cable of the target PC only based on a shape and/or color of a connector of the LAN-cable inserted in the hub. Thus, if the LAN-cable connector is similar or identical in shape and/or color to other LAN-cable connectors, the PC-maintenance staff cannot adequately check the PC antitheft state of or the connection state.

In view of the above circumstances, it is an object of the present invention to provide a lock assembly capable of substantially precluding a PC from being moved out so as to obtain an antitheft effect in a simplified structure.

It is another object of the present invention to provide a lock assembly capable of fastening a PC to its setup location without attaching any other additional member to a housing of the PC, so as to obtain an antitheft effect.

It is yet another object of the present invention to provide a lock assembly capable of locking a LAN-cable connector inserted in a socket of a PC in such a manner as to preclude the PC from being moved out so as to obtain an antitheft effect.

It is still another object of the present invention to provide a lock assembly for use in an intranet configuration designed to connect a plurality of PCs are connected to a server via a hub, capable of locking a plurality of LAN-cable connectors inserted, respectively, into a plurality of sockets of the hub in such a manner as to prevent the LAN-cable connectors from being removed the sockets and thereby preclude each of the PCs connected to the LAN-cables from being moved out so as to obtain an antitheft effect and an effect of preventing occurrence of troubles to be caused by improperly inserting or removing the LAN-cable connectors.

It is other object of the present invention to provide a lock assembly capable of, during an operation for checking a state of PC antitheft or a state of connection between a target PC and a hub, allowing the target PC to be reliably distinguished without relying on a shape and/or color of a connector of a LAN cable connected to the target PC.

DISCLOSURE OF THE INVENTION

In order to achieve the above objects, according to a first aspect of the present invention, there is provided a lock assembly adapted to be detachably attached to a LAN-cable connector which is integrally fixed to a LAN cable and adapted to be removably inserted into a socket and latched at an inserted position thereof. The lock assembly is operable, when attached to the LAN-cable connector, to allow the LAN-cable connector after being inserted into the socket to be locked at the inserted position, and, when detached from the LAN-cable connector, to allow the LAN-cable connector to be removed from the socket.

The lock assembly set forth in the first aspect of the present invention may comprise: first and second encircling members adapted to be separatably assembled together along a circumferential direction and to be attached to the LAN-cable connector in such a manner as to encircle an outer periphery of the LAN-cable connector substantially in close contact therewith; engagement means formed in the first encircling member and adapted to, in a state after the first and second encircling members are attached to the LAN-cable connector in such a manner as to encircle the outer periphery of the LAN-cable connector, prevent the first encircling member from being moved relative to the LAN-cable connector in an axial direction of the LAN-cable connector; and restriction means formed in the second encircling member and adapted to, in the state after the first and second encircling members are attached to the LAN-cable connector in such a manner as to encircle the outer periphery of the LAN-cable connector, restrict a latching-flap fixed to the LAN-cable connector from being moved in a latch-release direction.

In the lock assembly according to the above first specific embodiment of the first aspect of the present invention, either one of the first and second encircling members may be formed to cover three of four surfaces defining the outer periphery of the LAN-cable connector, and the other encircling member may be formed to cover a remaining one of the four surfaces defining the outer periphery of the LAN-cable connector.

In the lock assembly according to the above first specific embodiment of the first aspect of the present invention, the first encircling member may be formed to cover three of four surfaces defining the outer periphery of the LAN-cable connector, and the second encircling member may be formed to cover a remaining one of the four surfaces defining the outer periphery of the LAN-cable connector.

In the lock assembly according to the above first specific embodiment of the first aspect of the present invention, the engagement means may include an engagement protrusion engageable with a groove formed in at least one of a plurality of surfaces of the LAN-cable connector except for one of the surfaces having the latching-flap.

Further, the surface formed with the groove in the surfaces of the LAN-cable connector may be located on the opposite side of the surface having the latching-flap.

In the lock assembly according to the above first specific embodiment of the first aspect of the present invention, the latching-flap may be designed to release its latching state when it is pressed down toward a surface of the LAN-cable connector having the latching-flap, and the restriction means may include a restriction finger designed to, in the state after the first and second encircling members are attached to the LAN-cable connector in such a manner as to encircle the outer periphery of the LAN-cable connector, extend from the second encircling member to a position adjacent to an anchor end of the latching-flap so as to restrict the latching-flap from being pressingly moved downward.

The lock assembly according to the above first specific embodiment of the first aspect of the present invention may further include a lock adapted to be locked so as to unseparatably connect the first and second encircling members to one another and to be unlocked so as to allow the first and second encircling members to be separated from one another.

Further, the first and second encircling members may include first and second portions superimposable on one another, respectively, in the state after the first and second encircling members are attached to the LAN-cable connector in such a manner as to encircle the outer periphery of the LAN-cable connector. The first and second superimposable portions may be formed, respectively, with first and second lock holes adapted to be aligned with one another in such a manner as to allow a lock rod of the lock to continuously penetrate therethrough.

The lock assembly according to the above first specific embodiment of the first aspect of the present invention may further include a special screw adapted to be attached to the first and second encircling members so as to unseparatably connect the first and second encircling members to one another and to be detached from the first and second encircling members so as to allow the first and second encircling members to be separated from one another.

Further, the first and second encircling members may include first and second portions superimposable on one another, respectively, in the state after the first and second encircling members are attached to the LAN-cable connector in such a manner as to encircle the outer periphery of the LAN-cable connector. Either one of the first and second superimposable portions may be formed with a loose hole for allowing an externally threaded shank of the special screw to loosely penetrate therethrough, and the other superimposable portion may be formed with an internally threaded hole engageable with the externally threaded shank.

In order to achieve the above objects, according to a second aspect of the present invention, there is provided a lock assembly adapted to be detachably attached to a plurality of LAN-cable connectors each of which is integrally fixed to a corresponding one of a plurality of LAN cables and adapted to be removably inserted into a corresponding one of a plurality of sockets and latched at an inserted position thereof. The lock assembly is operable, when attached to the plurality of LAN-cable connectors, to allow the plurality of LAN-cable connectors after being inserted into the corresponding sockets to be locked at the respective inserted positions, and, when detached from the plurality of LAN-cable connectors, to allow the plurality of LAN-cable connectors to be removed from the corresponding sockets.

The lock assembly set forth in the second aspect of the present invention may comprise: first and second encircling members adapted to be separatably assembled together along an outer periphery surrounding the plurality of LAN-cable connectors and to be attached to the plurality of LAN-cable connectors in such a manner as to clamp the outer periphery surrounding the plurality of LAN-cable connectors substantially in close contact therewith; engagement means formed in the first encircling member and adapted to, in a state after the first and second encircling members are attached to the plurality of LAN-cable connectors in such a manner as to encircle the outer periphery surrounding the plurality of LAN-cable connectors, prevent the first encircling member from being moved relative to the plurality of LAN-cable connectors in an axial direction of each of the plurality of LAN-cable connectors; and restriction means formed in the second encircling member and adapted to, in the state after the first and second encircling members are attached to the plurality of LAN-cable connectors in such a manner as to encircle the outer periphery surrounding the plurality of LAN-cable connectors, restrict a latching-flap fixed to each of the plurality of LAN-cable connectors from being moved in a latch-release direction.

In the lock assembly according to the above first specific embodiment of the second aspect of the present invention, either one of the first and second encircling members may be formed to cover three of four surfaces defining the outer periphery surrounding the plurality of LAN-cable connectors, and the other encircling member may be formed to cover a remaining one of the four surfaces defining the outer periphery surrounding the plurality of LAN-cable connectors.

In the lock assembly according to the above first specific embodiment of the second aspect of the present invention, the first encircling member may be formed to cover three of four surfaces defining the outer periphery surrounding the plurality of LAN-cable connectors; and the second encircling member may be formed to cover a remaining one of the four surfaces defining the outer periphery surrounding the plurality of LAN-cable connectors.

In the lock assembly according to the above first specific embodiment of the second aspect of the present invention, the engagement means may include a plurality of engagement protrusions each engageable with a groove formed in at least one of a plurality of surfaces of a corresponding one of the plurality of LAN-cable connectors, except for one of the surfaces having the latching-flap.

Further, the surface formed with the groove in each of the plurality of LAN-cable connectors may be located on the opposite side of the surface having the latching-flap.

In the lock assembly according to the above first specific embodiment of the second aspect of the present invention, the latching-flap in each of the plurality of LAN-cable connectors may be designed to release its latching state when it is pressed down toward a surface of the LAN-cable connector provided therewith, and the restriction means may include a restriction finger designed to, in the state after the first and second encircling members are attached to the plurality of LAN-cable connectors in such a manner as to encircle the outer periphery surrounding the plurality of LAN-cable connector, extend from the second encircling member to a position adjacent to an anchor end of the latching-flap so as to restrict the latching-flap from being pressingly moved downward.

The lock assembly according to the above first specific embodiment of the second aspect of the present invention may further include a lock adapted to be locked so as to unseparatably connect the first and second encircling members to one another and to be unlocked so as to allow the first and second encircling members to be separated from one another.

Further, the first and second encircling members may include first and second portions superimposable on one another, respectively, in the state after the first and second encircling members are attached to the plurality of LAN-cable connectors in such a manner as to encircle the outer periphery surrounding the plurality of LAN-cable connectors. The first and second superimposable portions may be formed, respectively, with first and second lock holes adapted to be aligned with one another in such a manner as to allow a lock rod of the lock to continuously penetrate therethrough.

The lock assembly according to the above first specific embodiment of the second aspect of the present invention may further include a special screw adapted to be attached to the first and second encircling members so as to unseparatably connect the first and second encircling members to one another and to be detached from the first and second encircling members so as to allow the first and second encircling members to be separated from one another.

Further, the first and second encircling members may include first and second portions superimposable on one another, respectively, in the state after the first and second encircling members are attached to the plurality of LAN-cable connectors in such a manner as to encircle the outer periphery surrounding the plurality of LAN-cable connectors. Either one of the first and second superimposable portions may be formed with a loose hole for allowing an externally threaded shank of the special screw to loosely penetrate therethrough, and the other superimposable portion may be formed with an internally threaded hole engageable with the externally threaded shank.

In the lock assembly according to the above first specific embodiment of the first or second aspect of the present invention, the first and second encircling members may be assembled to define four surfaces, and at least one of the surfaces may have distinguishing means.

In this case, the distinguishing means may include a color sticker.

In the lock assembly according to the above first specific embodiment of the first or second aspect of the present invention, the first and second encircling members may be assembled to define four surfaces, and at least one of the surfaces may be colored.

BEST MODE FOR CARRYING OUT THE INVENTION

With reference to the accompanying drawings, a lock assembly according to a preferred embodiment of the present invention will now be specifically described.

First Embodiment

Figure 1:
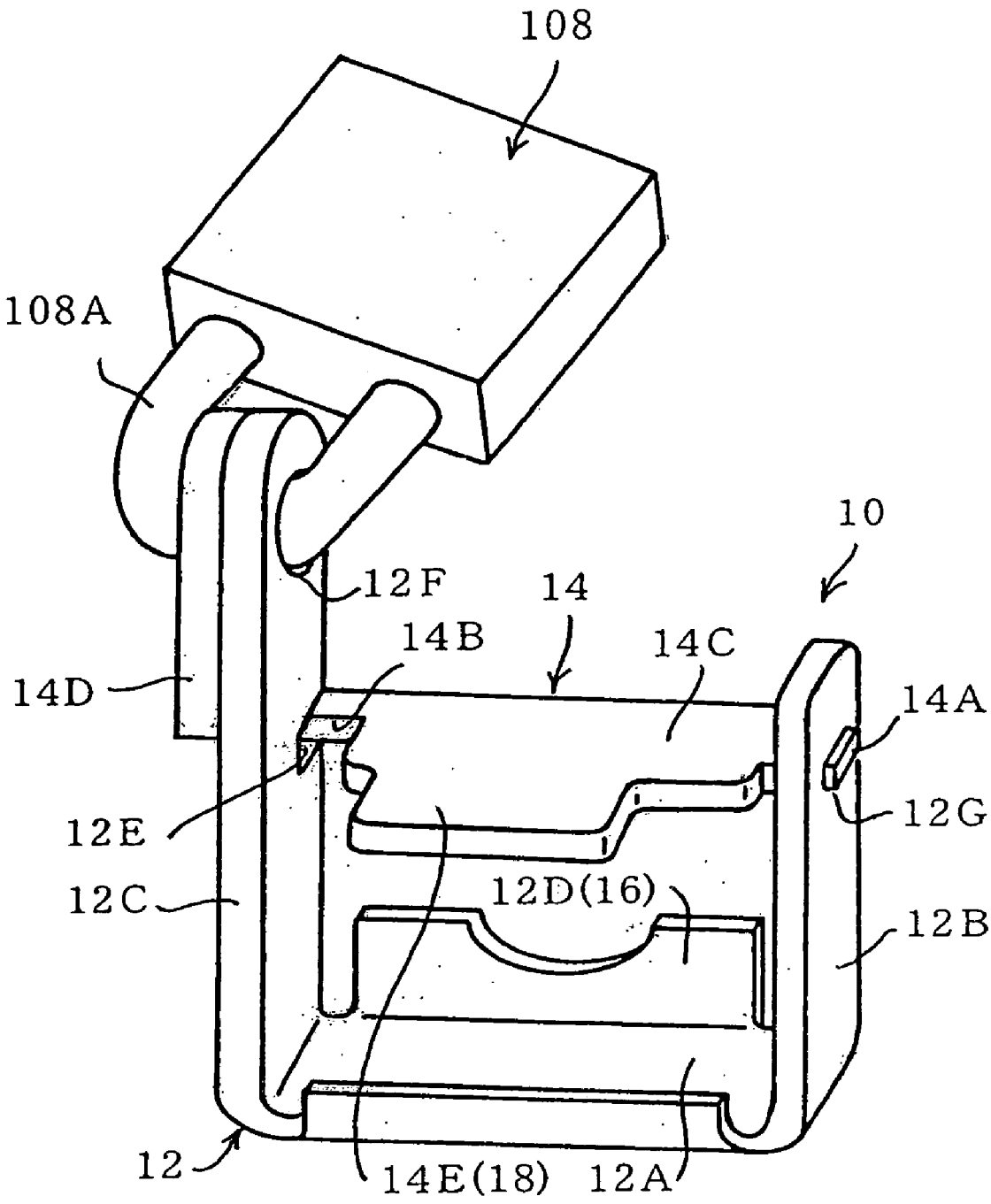
FIG. 1 is a perspective view showing a lock assembly according to a first embodiment of the present invention.
Figure 2:
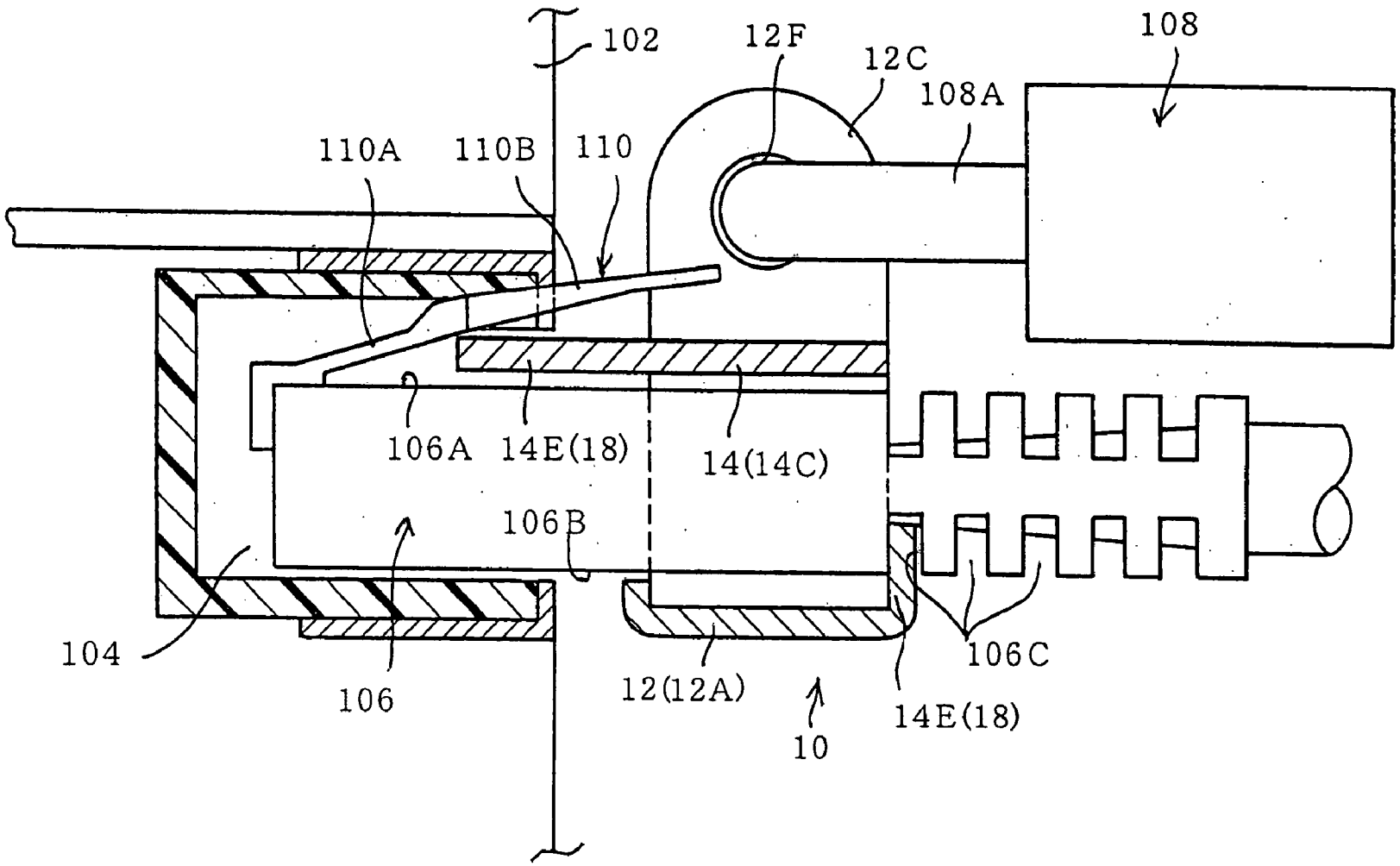
FIG. 2 is a partially sectional view showing a connector which is inserted in a socket and locked by the lock assembly illustrated in FIG. 1.

As shown in FIGS. 1 and 2, a lock assembly 10 according to a first embodiment of the present invention is designed to be detachably attached to a LAN-cable connector (hereinafter referred to simply as "connector") 106 which is integrally fixed to an end of a LAN cable 100 and adapted to be removably inserted into a socket 104 of a computer (hereinafter referred to simply as "PC") 102 and latched at an inserted position thereof.

As shown in FIG. 1, the lock assembly 10 is designed to be locked by a lock 108 in its assembled state. As shown in FIG. 2, the lock assembly 10 is operable, when attached to the connector, to allow the connector after being inserted into the socket 104 to be locked at the inserted position, and, when detached from the connector 106, to allow the connector 106 to be pulled out of or removed from the socket 104. That is, the lock assembly 10 is operable to lock the connector 106 at the inserted position so as to substantially prohibit the PC 102 from being moved from its setup location and thereby prevent theft of the PC 102.

Fundamentally, this lock assembly 10 comprises first and second encircling members 12, 14 adapted to be separatably assembled together along a circumferential direction and to be attached to the connector 106 in such a manner as to encircle an outer periphery of the connector 106 substantially in close contact therewith, an engagement protrusion 16 serving as engagement means which is integrally formed in the first encircling member 12 and adapted to, in a state after the first and second encircling members 12, 14 are attached to the connector 106 in such a manner as to encircle the outer periphery of the connector 106, prevent the first encircling member 12 from being moved relative to the connector 106 in an axial direction of the connector 106, and a restriction finger 18 serving as restriction means which is formed in the second encircling member 14 and adapted to, in the state after the first and second encircling members 12, 14 are attached to the connector 106 in such a manner as to encircle the outer periphery of the connector 106, restrict a latching-flap 110 fixed to a top surface 106A of the connector 106 (the term "top surface" herein means a surface on the opposite side of a bottom surface 106B having a number of terminals exposed to outside) from being moved in a latch-release direction.

As shown in FIGS. 3 to 6, the first encircling member 12 is formed in an approximately U shape in front view. Specifically, the first encircling member 12 integrally has a bottom wall 12A adapted to be disposed in opposed relation to the bottom surface A of the connector 106 (the term "bottom surface" herein means a surface having a number of terminals exposed to outside), a first upright wall 12B standing upright from a first one of laterally opposite ends of the bottom wall 12A, a second upright wall 12C standing upright from the other or second end of the bottom wall 12A, and a third upright wall 12D standing upright from a rear edge of the bottom wall 12A extending in a direction orthogonal to the axial direction (the term "frontward" herein means a direction oriented to a distal end of the LAN cable 100, and the term "rearward" herein means a direction opposite to the frontward direction).

Figure 3:
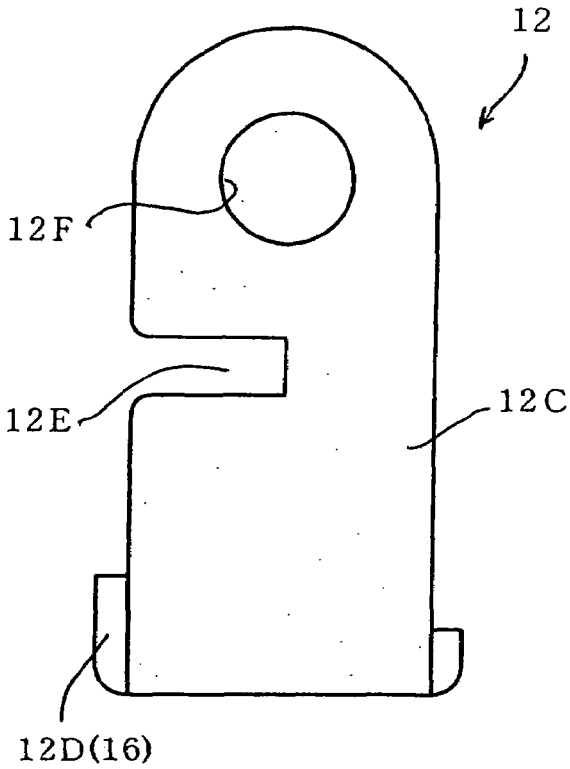
FIG. 3 is a left side view of a first encircling member of the lock assembly illustrated in FIG. 1.
Figure 4:
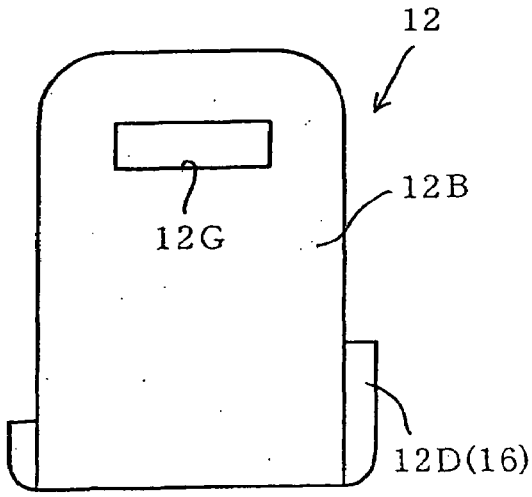
FIG. 4 is a right side view of the first encircling member illustrated in FIG. 3.
Figure 5:
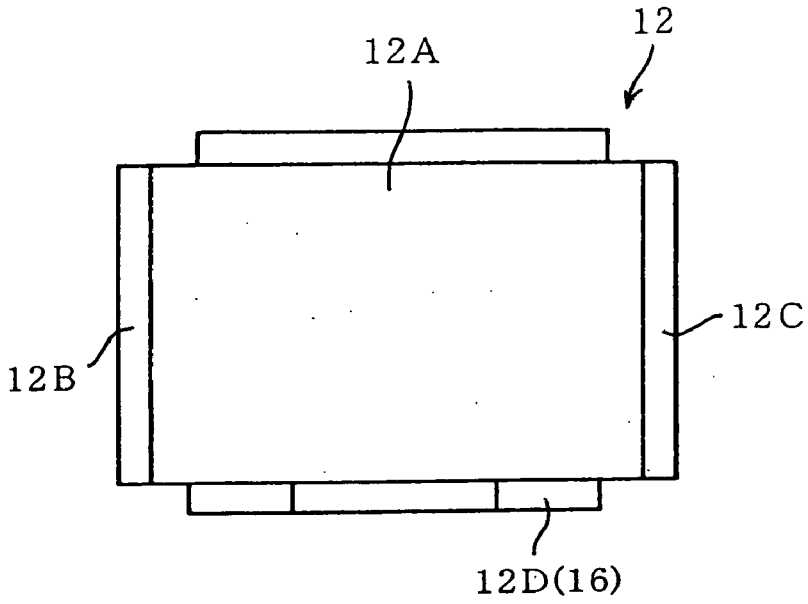
FIG. 5 is a top plan view of the first encircling member illustrated in FIG. 3.
Figure 6:
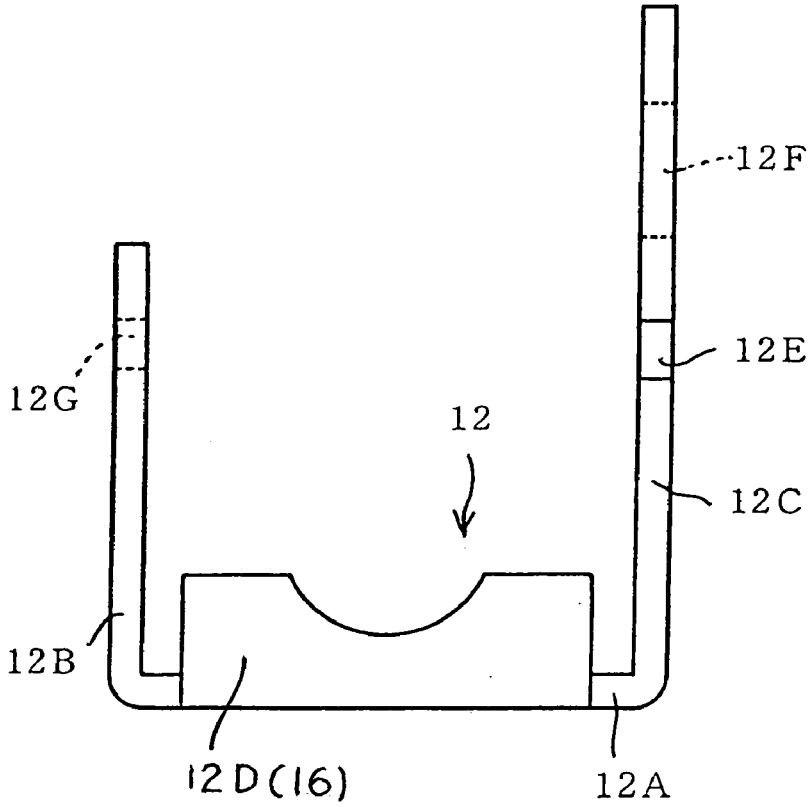
FIG. 6 is a back view of the first encircling member illustrated in FIG. 3.

As shown in FIG. 3 and FIG. 4, the first upright wall 12B has an upper portion formed with a hook hole 12G penetrating in a thickness direction thereof. The hook hole 12G has a shape allowing a hook protrusion 14A of the second encircling member 14 to be inserted in a horizontal direction. The second upright wall 12C is formed to have a height greater than that of the first upright wall 12B, and the higher portion of the second upright wall 12C is formed with a first lock hole 12F allowing a lock rod 108A of the lock 108 to be penetrate therethrough. Further, the second upright wall 12C is formed with an engagement groove 12E extending frontward from a rear edge thereof by about one-half of a width thereof, at a position opposed to (or at the same height as that of) the hook groove 12E. The engagement groove 12E has a shape allowing an engagement groove 14B of the second encircling member 14 to be fitted therein in a nested manner.

The aforementioned engagement protrusion 16 is defined by the third upright wall 12D. Specifically, as shown in FIG. 2, in the state after the lock assembly 10 is attached to the connector 106, this engagement protrusion 16 is designed to be engaged with one of a number of grooves 106C formed in a rear region of the connector 106 so as to prohibit the first encircling member 12 (or the entire lock assembly 10) from being moved in an axial direction of the connector 106.

Figure 7:
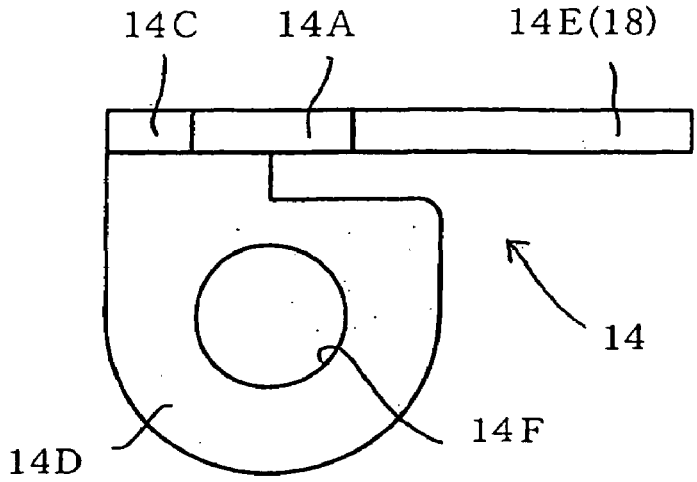
FIG. 7 is a right side view of a second encircling member of the lock assembly illustrated in FIG. 1.
Figure 8:
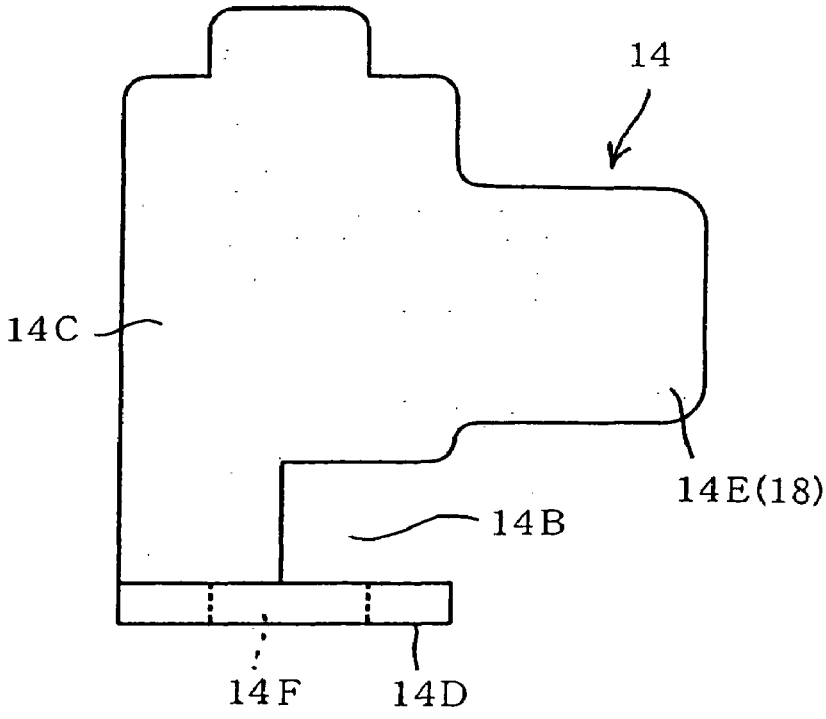
FIG. 8 is a top plan view of the second encircling member illustrated in FIG. 7.
Figure 9:
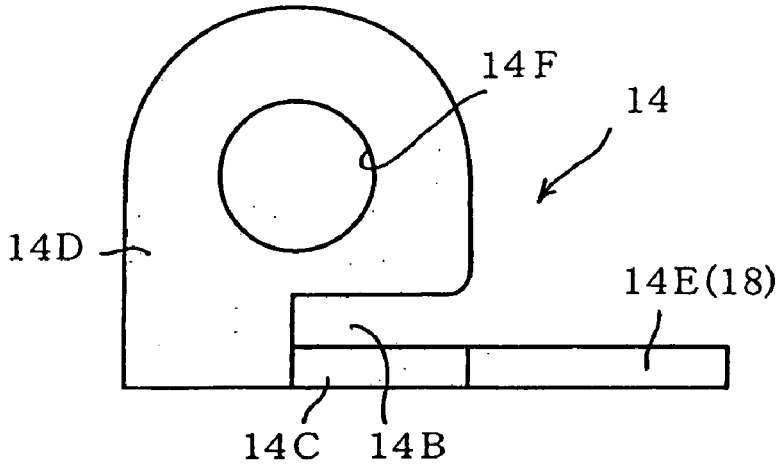
FIG. 9 is a left side view of the second encircling member illustrated in FIG. 7.

As shown in FIGS. 7 to 9, the second encircling member 14 is formed in an approximately L shape in front view. Specifically, the second encircling member 14 integrally has a plate-shaped body 14C, the hook protrusion 14A which extends laterally outward from one of laterally opposite ends of the body 14C on the same side of the first end of the bottom wall 12A of the first encircling member 12 and has a shape capable of being fitted into the hook hole 12G of the first encircling member 12, an upright wall 14D standing upright from the other end of the body 14C on the same side of the second end of the bottom wall 12A of the first encircling member 12, and a protrusion finger 14E extending frontward from a front edge of the body 14C. In the first embodiment, the protrusion finger 14E is formed to serve as the restriction finger 18.

Further, as shown in FIG. 8, the upright wall 14D is formed with a second lock hole 14F adapted to be aligned with the first lock hole 12F in the state after the first and second encircling members 12, 14 are assembled together. The end region of the body 14A on the side of the upright wall 14D is cut out rearward from the front edge thereof by about on-half of a width thereof to form the engagement groove 14B having a shape capable of being fitted into the engagement groove 12E in a nested manner.

Figure 10:
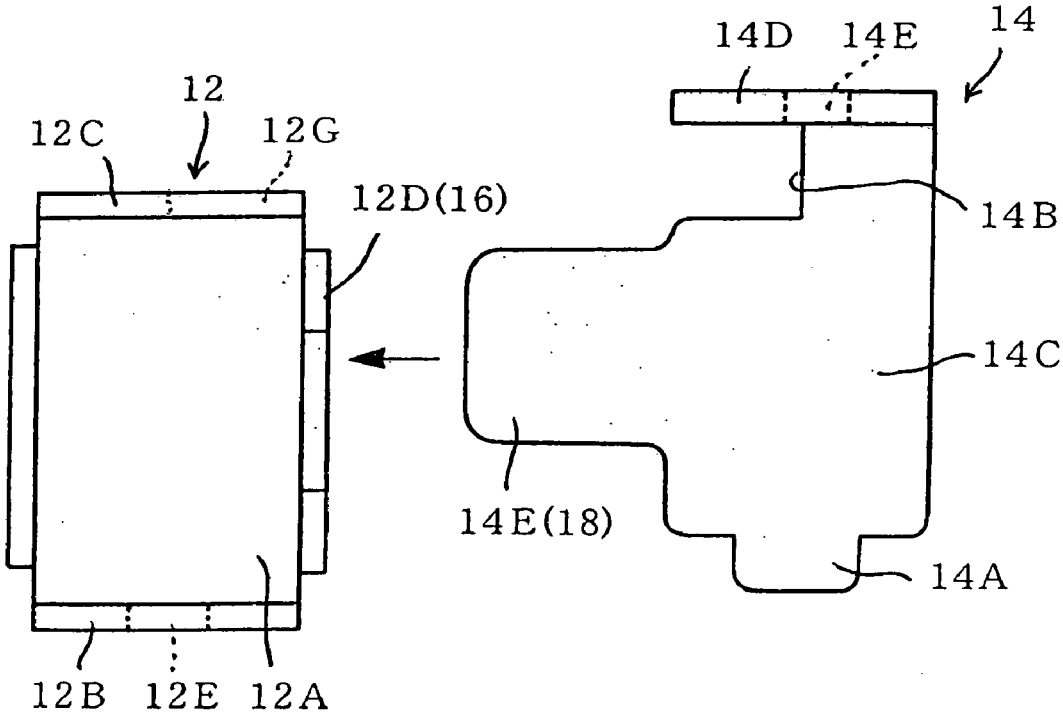
FIG. 10 is a top plan view showing the first and second encircling members just before being assembled together.
Figure 11:
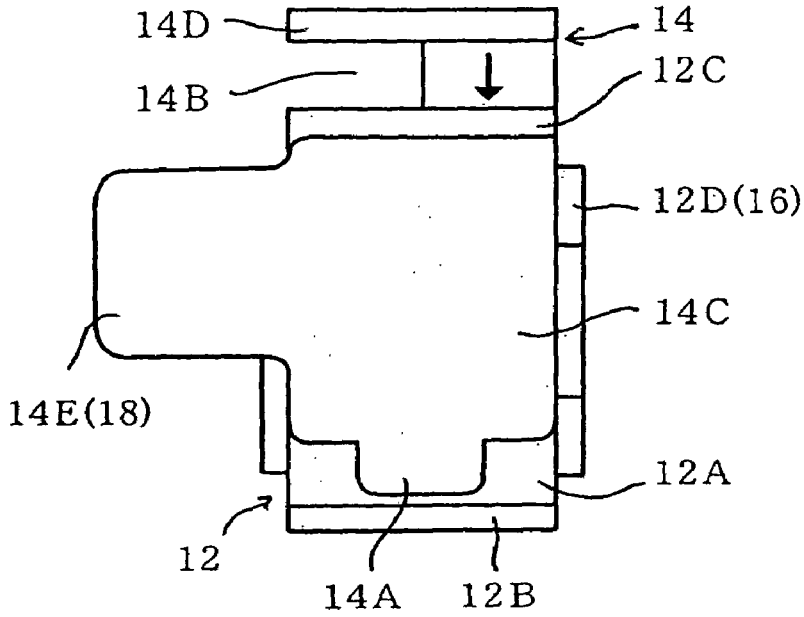
FIG. 11 is a top plan view showing the first and second encircling members just after being assembled together by moving the second encircling member from a position illustrated in FIG. 10.
Figure 12:
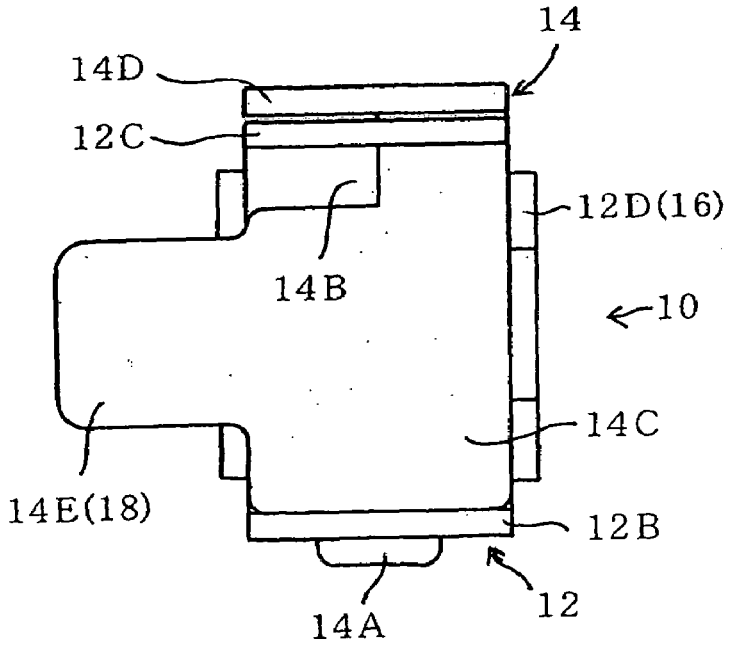
FIG. 12 is a top plan view showing the first and second encircling members after the second encircling member at a position illustrated in FIG. 11 is moved relative to the first encircling member along a width or lateral direction thereof.

With reference to FIGS. 10 to 12, a process of assembling the above first and second encircling members 12, 14 together will be described below.

Firstly, the second encircling member 14 is attached to the first encircling member 12, from the side of the rear edge of the first encircling member 12. In this operation, the second encircling member 14 is attached to the first encircling member 12 in such a manner that the hook protrusion 14A is located close to an inner surface of the first upright wall 12B of the first encircling member 12, and at the same height as that of the hook hole 12G of the first upright wall 12B. Consequently, the upright wall 14D of the second encircling member 14 is located outside the second upright wall 12C of the first encircling member 12, and the engagement groove 14B of the second encircling member 14 is engaged with the engagement groove 12E of the first encircling member 12 in a nested manner.

In a state just after the second encircling member 14 is attached to the first encircling member 12 in the above manner, the hook protrusion 14A is located just inside the hook hole 126, and the engagement grooves 14B, 12E are engaged with one another in a nested manner.

Figure 13:
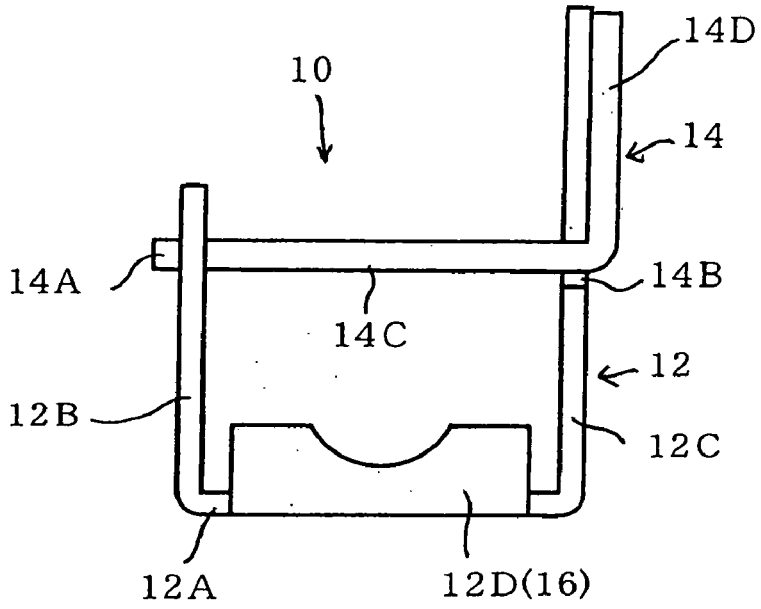
FIG. 13 is a back view showing the assembled first and second encircling members illustrated in FIG. 12.
Figure 14:
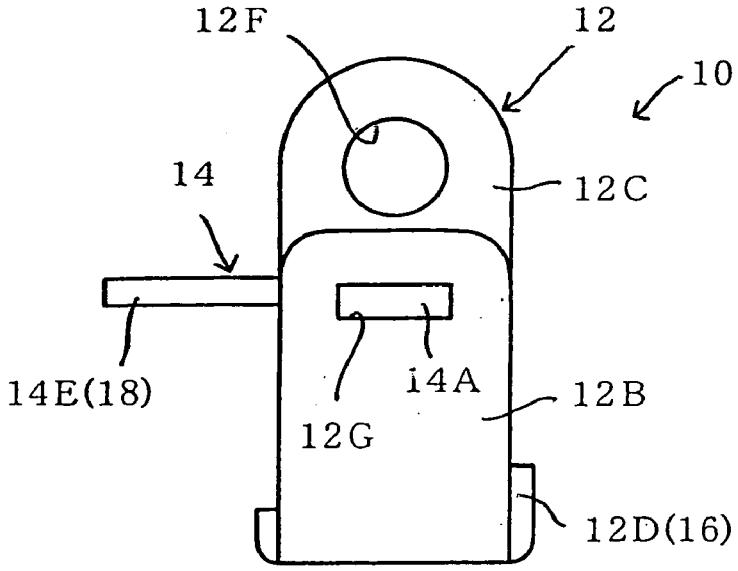
FIG. 14 is a right side view showing the assembled first and second encircling members illustrated in FIG. 12.
Figure 15:
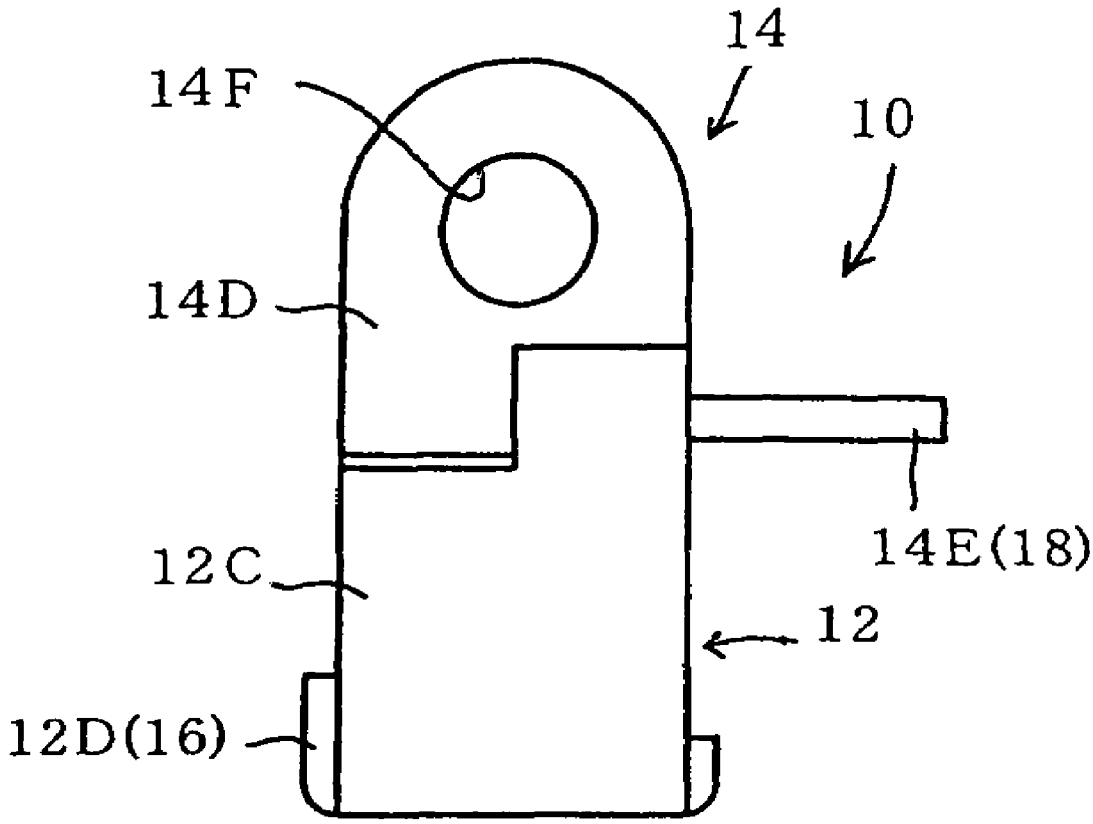
FIG. 15 is a left view showing the assembled first and second encircling members illustrated in FIG. 12.

Then, the second encircling member 14 is moved laterally in such a manner as to be pressed toward the first encircling member 12. Through this operation, the hook protrusion 14A is fitted into the hook hole 126, and the second upright wall 12C and the upright wall 14D are superimposed on one another, as shown in FIG. 12, while aligning their lock holes 12F, 14F with one another. Then, the lock rod 108A of the lock is continuously inserted through the lock holes 12F, 14F. In this manner, the lock assembly 10 is formed in a separatable manner, as shown in FIGS. 13 to 15.

While the above assembling process has been described in disregard of a relationship with the connector 106, the lock assembly 10 is actually attached to an outer periphery of the connector 106. Thus, with reference to FIG. 2 again, a process of attaching the lock assembly 10 to the connector 10 will be described below. In the following description, the process of assembling the lock assembly itself has already described, and its description will be omitted.

Firstly, the first encircling member 12 is attached to the connector 106 in such as manner as to encircle three surfaces (i.e. opposite side surfaces and the bottom surface) of the connector 106. In a state after this operation, the bottom wall 12A of the first encircling member 12 is located in opposed relation to the bottom surface of the connector 106. In this state, the engagement protrusion 16 (or the third upright wall 12D) is inserted into one of the grooves formed in the rear region of the connector 106 to prohibit the first encircling member 12 from being moved in the axial direction.

After the first encircling member 12 is attached to the connector 106 in such as manner as to encircle the three surfaces of the connector 106, the second encircling member 14 is attached to the first encircling member 12 in such as manner as to encircle the top surface of the connector 106. In a state after the first and second encircling members 12, 14 are assembled together in such a manner as to encircle the outer periphery of the connector 106, the restriction finger 18 (or the protrusion finger 14E) integrally formed with the second encircling member 14 extends to a position close to an anchor end of the flap 110 of the connector 106.

Thus, in the state after the lock assembly 10 is attached to the connector 106, even if it is attempted to press the flap 110 downward so as to release the latch of the connector 106 relative to the socket 104, the restriction finger 18 extending up to the position close to the anchor end of the flap 110 hinders the flap 110 from being pressingly moved downward to preclude the latch of the connector 106 relative to the socket 104 from being released. That is, the lock assembly 10 according to the first embodiment makes it possible to prevent the latch of the inserted position of the connector 106 relative to the socket 106 from being released, or allow the connector 106 to be locked to the socket 104. This point will be described in more detail later As above, the lock assembly 10 according to the first embodiment be attached to the connector 106 in such a manner as to encircle the outer periphery of the connector makes it possible to prohibit the flap 110 of the connector 106 from being pressingly moved downward or from being moved in a direction allowing the latch of the inserted position of the connector 106 to be released, so as to lock the connector 106 to the socket 104. Thus, connections in the LAN cable 100 cannot be released. That is, even if it is attempted to forcedly move the PC 102 mechanically connected to the LAN cable 100, from its setup location, the LAN cable 100 cannot be detached from the PC 102 to preclude carrying-out of the PC 102. This makes it possible to reliably prevent theft of the PC 102.

Figure 16:
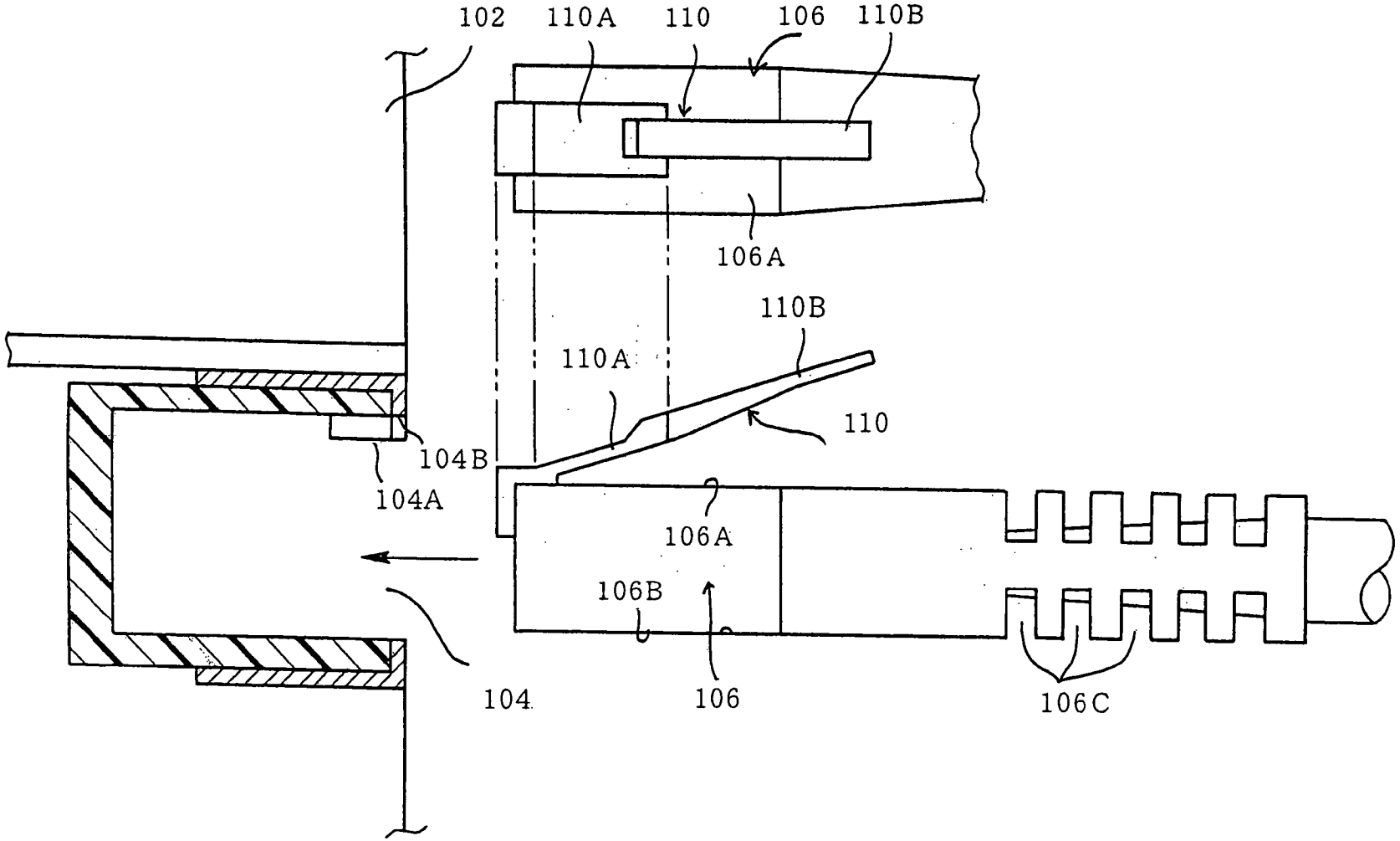
FIG. 16 is a partially sectional view showing an operation for inserting a connector into a socket.

For better understanding, an operation for inserting the connector 106 into the socket 104 in a normal state (or without using the lock assembly 10 according to the first embodiment) will be described below with reference to FIGS. 16 and 17.

The flap 110 is fixed onto the top surface 106A of the connector 106, and designed to be elastically deformed by applying a pressing force thereto. Specifically, as shown in FIG. 16, an anchor end of the flap 110 is integrally fixed at a front end of the upper surface 106A of the connector 106.

In the flap 110, an anchor end region 110A is formed to have a relatively wide width, and a distal end region 110B extending from the anchor end region 110A is formed to have a width less than that of the anchor end region 110A. That is, the flap 110 has a two-step structure in terms of width, and a step is formed at an approximately midpoint thereof.

Figure 17:
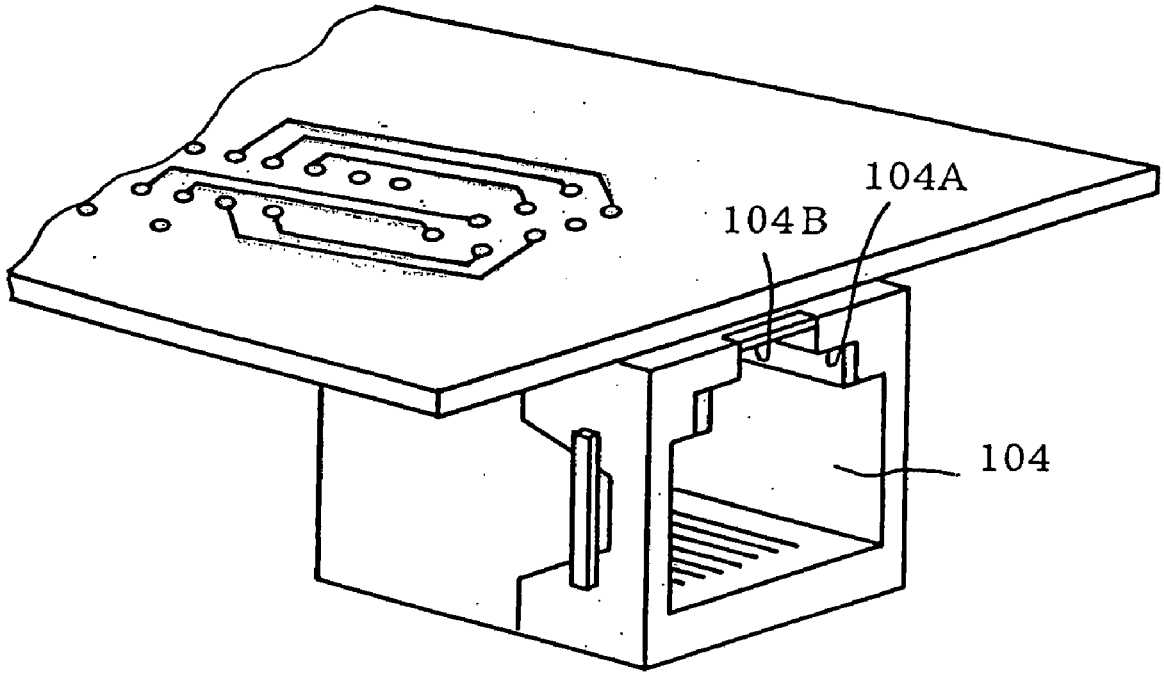
FIG. 17 is a fragmentary perspective view showing the structure of the socket illustrated in FIG. 16.

As shown in FIG. 17, in the socket 104, an upper edge of an opening is formed with a first groove 104A having a shape which allows the wide anchor end region 110A of the flap 110 to be inserted thereinto. An upper wall surface of the first groove 104A is formed with a second groove 104B having a shape which allows only the narrow distal end region 110B to be inserted thereinto while precluding the wide anchor end region 110A of the flap 110 from being inserted thereinto. The second groove 104B is formed to have a thin thickness in the axial direction so as to define a so-called engagement shoulder.

The socket 104 has the above structure. Thus, as shown in FIG. 16, when the connector 106 is inserted into the socket 104, the wide anchor end region 110A of the flap 110 is gradually moved downward by the upper wall while passing through the first groove 104A. Then, when the step as a transitional point to the narrow distal end region 110B passes through the shoulder, the narrow distal end region 110B fallingly enters into the second groove 104B based on its own elastic force, and thereby the step of the flap 110 is engaged with the shoulder. The relationship in engagement between the step and the shoulder allows an inserted position of the connector 106 in the socket 104 to be latched in a non-disengageable manner.

In an operation for pulling out or removing the connector 106 from this inserted position, the flap 110 is pressed down against it own elastic force. According to this pressing-down operation, the engagement between the step and the shoulder is released so as to allow the connector 106 to be removed from the socket 104. That is, the latch of the connector 106 relative to the socket 104 is released. In this released state, the connector 106 is pulled out of the socket 104 and removed from the socket 104.

When the lock assembly 10 according to the first embodiment is used in the above connector 106 and socket 104, the restriction finger 18 integrally formed with the second encircling member 14 of the lock assembly 10 hinders the flap 110 from being pressingly moved downward so as to prevent the latch from being released due to pressing-down of the flap 110. Thus, the connector 106 will be kept at the inserted position in the socket 104 (or locked to the socket 104) to reliably prohibit the connector 106 from being removed from the socket 104.

As described above in detail, the lock assembly 10 according to the first embodiment can be used for allowing the connector 106 inserted into the PC 102 to be locked at an inserted position in the socket 104 so as to obtain an effect of being able to effectively fasten the PC 102 to its setup location. This makes it possible to effectively prevent the theft of the PC 102 including improperly moving the PC 102 to other location. Specifically, as compared with the conventional technique designed to fasten the PC 102 to its setup location using the locking coupling cord, such as wire, the lock assembly 10 according to the first embodiment can obtain an antitheft effect based on locking the connector in a state after being mechanically connected to the PC 102 (or prohibiting the connector in a state after being mechanically connected to the PC 102 from being removed) without bonding any other additional member to a housing of the PC 102). Thus, this lock assembly 10 is highly advantageous.

Particular, in a PC 102 using the lock assembly 10 according to the first embodiment, a person who attempts to move out the PC 102 (enforcedly move the PC 102 from its setup location) has no choice but to cut off the LAN cable 100. As to this point, even in the conventional technique using the locking coupling cord, such as wire, the coupling cord, such as wire, is likely to be cut off using a strong cutter. Thus, the coupling is undesirable released to allow the PC 102 to be moved out.

The conventional coupling code, such as wire, is designed to simply couple a PC 102 mechanically to a stationary location, but it is not designed to detect cutoff of the coupling code, such as wire. In contrast, the lock assembly 10 according to the first embodiment is designed to lock the connection between the PC 102 and the LAN cable 100. Thus, in releasing the connection, there is no alternative but to cut off the LAN cable 100. For example, when the LAN cable 100 is cut off using a metal cutter, the cutter blade is brought into contact with cords in the LAN cable 100 to cause short-circuiting, and this short-circuiting phenomenon will be detected by a server connected to which the LAN cable 100. This allows the server to recognize an unintended cutoff of the LAN cable 100. Further, even is the short-circuiting phenomenon is not detected, the LAN cable 100 after being cut off has codes in an open state, and the open state will be detected by the server. This also allows the server to recognize an unintended cutoff of the LAN cable 100.

Thus, the lock assembly 10 according to the first embodiment makes it possible to not only prevent theft of a PC 102 but also quickly detect the fact of theft in the event of theft so as to facilitate improving so-called "security".

A PC 102 for internal operations is typically connected to a network. Thus, the PC 102 is actually used under the condition that a LAN cable 100 is inserted in a connector-receiving socket 104 on the back of a housing of the PC 102 through a connector 106. When the PC 102 is connected to one network, and a user intends to access another network for his/her own convenience, the user may replacingly insert a new LAN cable connected to another network. Such an arbitrary user's action is undesirable from the standpoint of company, and there is the need for reliably prohibiting the action.

However, there has been no effective means for preventing such an arbitrary insertion/removal of a connector 106. In addition to the aforementioned antitheft effect, the lock assembly 10 according to the first embodiment can be used for providing an effect of being able to reliably prevent arbitrary replacement of a connector 106 and prevent connection to another network.

When a PC 102 for use in internal operations is connected to a server via a network, it should be strictly prohibited to import business date to a PC for personal use. However, the connector 106 inserted in a socket 104 of the business PC 102 can be readily removed, and it is actually likely that the connector 104 is replacingly inserted into the private PC, and the server is accessed from the private PC to import business data.

In addition to the aforementioned antitheft effect, as measures against this problem, the lock assembly 10 according to the first embodiment can be used for providing an additional effect of being able to reliably prevent arbitrary replacement of a connector 106 to effectively prevent connection of a private PC to a server so as to maintain security of data in the server.

It is understood that the present invention is not limited to the above embodiment, but various modifications and changes may be made therein without departing from spirit and scope of the invention.

For example, while the lock assembly according the first embodiment comprises the first encircling member 12 provided with the engagement protrusion 16 and formed in a U shape in front view, and the second encircling member 14 provided with the restriction finger 18 and formed in an L shape in front view, the present invention is not limited to this configuration. For example, the first encircling member 12 provided with the engagement protrusion 16 may be formed in an L shape in front view, and the second encircling member 14 provided with the restriction finger 18 may be formed in an L shape in front view, to obtain the same effects as those in the first embodiment.

Further, while the lock holes 12F, 14F in the first embodiment are formed, respectively, in the second upright wall 12C and the upright wall 14D each standing upright, the present invention is not limited to this configuration. For example, in the first encircling member 12, an upper portion of the second upright wall 12C may be bend laterally outward in a horizontal direction, and the lock hole 12F may be formed in this horizontal portion. Further, instead of the L shape in front view, the second encircling member 14 may be formed in an approximately flat-plate shape and to extend further outward relative to the second upright wall 12C of the first encircling member 12 and superimpose it on the above horizontal portion of the second upright wall 12C, and lock hole 14F may be formed in this extension portion. The lock holes 12F, 14F may be formed to be aligned with one another when the horizontal portion and the extension portion are superimposed on one another. It is understood that this structure can obtain the same effects as those in the first embodiment.

Second Embodiment

With reference to the accompanying drawings, a lock assembly according to a second embodiment of the present invention will now be described in detail.

Figure 18:
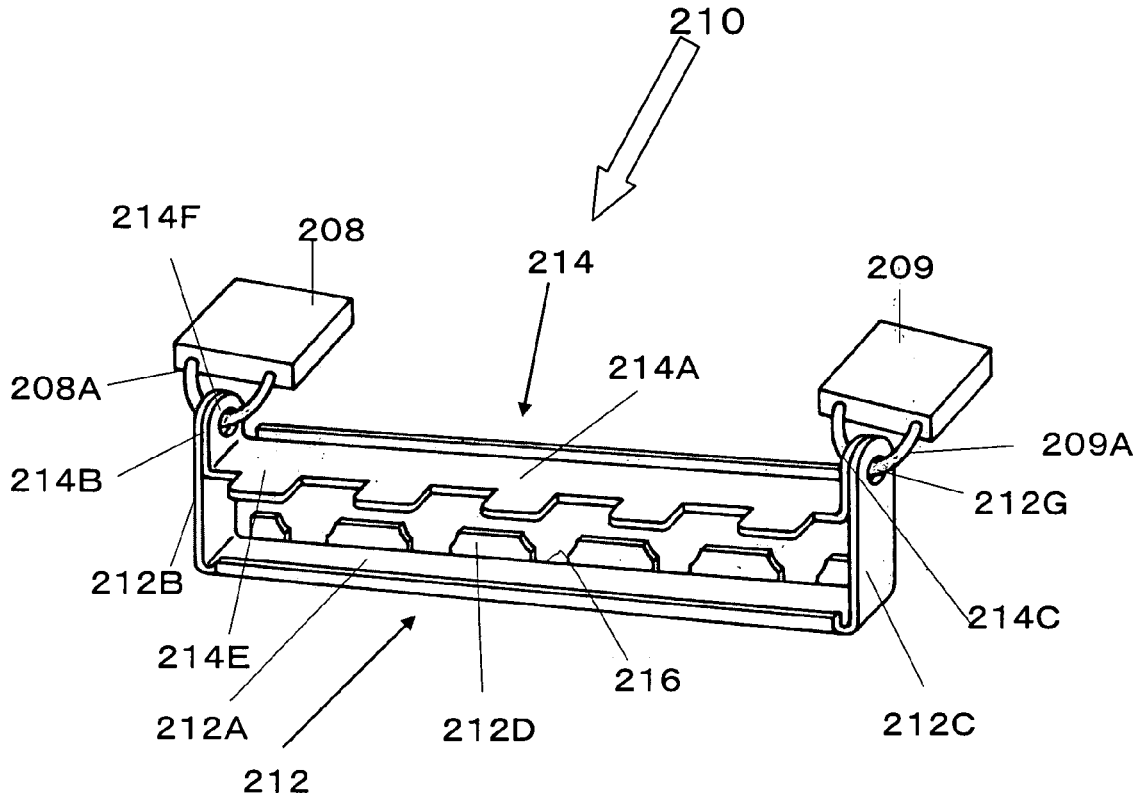
FIG. 18 is a perspective view showing a lock assembly according to a second embodiment of the present invention.
Figure 19:
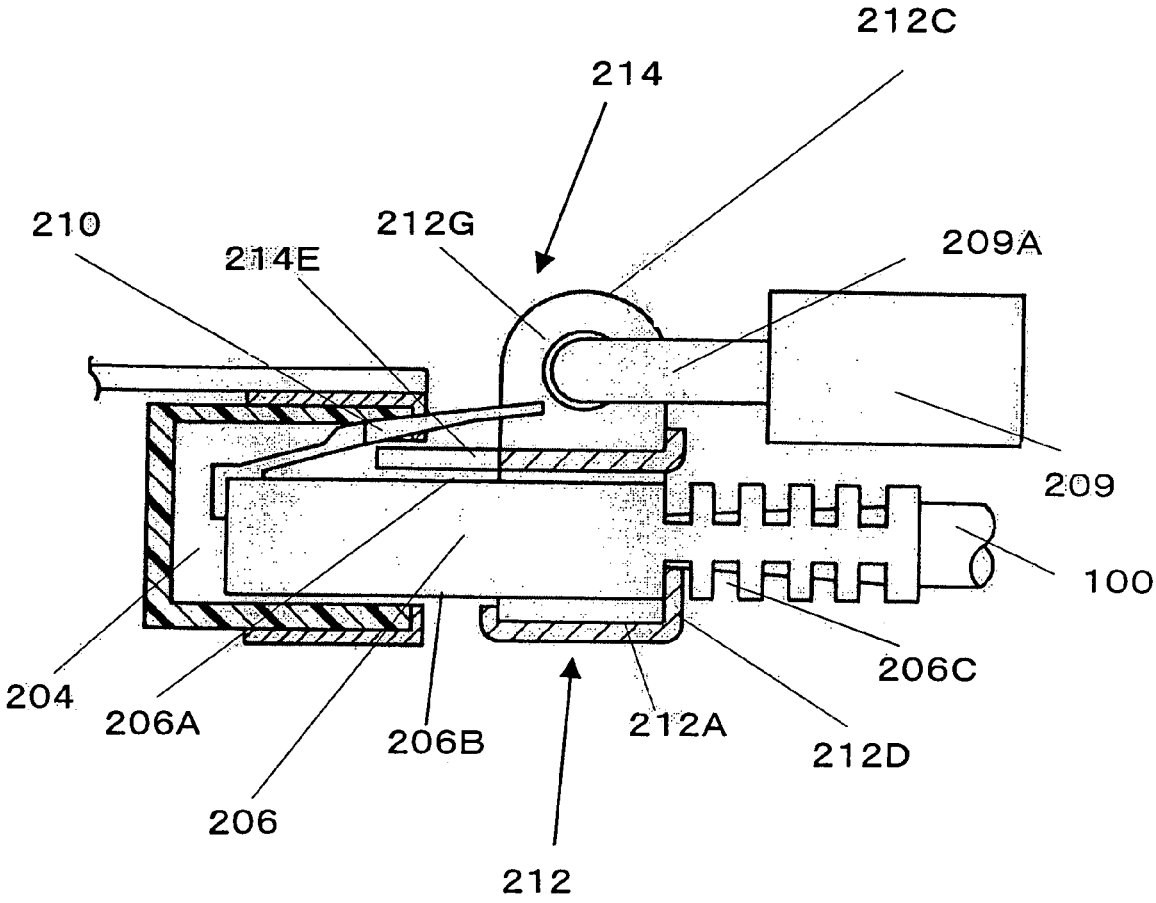
FIG. 19 is a partially sectional view showing a connector which is inserted in a socket and locked by the lock assembly illustrated in FIG. 18.

FIG. 18 is a perspective view showing the lock assembly according to the second embodiment, and FIG. 19 is a partially sectional view showing a connector which is inserted in a socket and locked by the lock assembly.

As shown in FIGS. 18 and 19, the lock assembly 210 comprises a first encircling member 212, and a second encircling member 214. The lock assembly 210 is attached to a LAN cable connector (hereinafter refereed to simply as "connector) 206 in such a manner as to lock the connector 206 inserted in a socket 204 of a hub of an intranet or release the lock.

Specifically, in a state after this lock assembly 210 is attached to the connector 206, when two locks 208, 209 are locked, this lock assembly 210 is operable to lock the connector 206 inserted in the socket 204. Further, when two locks 208, 209 are unlocked, the lock assembly 210 is detached from the connector 206 to allow the connector 206 to be pulled out of or removed from the socket 204. In this manner, the lock assembly 210 is operable to lock the connector 206 inserted in the socket 204 so as to prevent the connector 206 from being moved from the hub and thereby prevent theft of a PC.

Firstly, with reference to FIG. 18, the lock assembly 210 will be described in detail. The second encircling member 214 is attached to be superimposed on an inner upper portion of the first encircling member 212 (the term "upper" means the upper side in figures). In the first encircling member 212, a first upright wall 212B and a second upright wall 212C stand upright, respectively, from opposite ends of a bottom wall 212A. A first upright wall 214B and a second upright wall 214 C standing upright, respectively, from opposite ends of a body 214A of the second encircling member 214, are disposed inside, respectively, the first upright wall 212B and the second upright wall 212C, in a superimposed manner. A lock hole 212F of the first encircling member 212 is aligned with a lock hole 214F of the second encircling member 214, and a lock rod 208A is inserted through lock holes 212F, 214F to allow a lock 208 to be locked. Further, a lock hole 212G of the first encircling member 212 is aligned with a lock hole 214G of the second encircling member 214, and a lock rod 208A is inserted through lock holes 2126, 214G to allow a lock 209 to be locked.

With reference to FIG. 19, the lock assembly 210 will be described in detail. FIG. 19 is a partially sectional view showing the lock assembly 210 comprising the first encircling member 212 and the second encircling member 214 attached to connector 206, viewing from the side of the uptight wall 212C. When the lock 209 is locked, the connector 206 is locked at an inserted position in the socket 204. Specifically, in a state after the connector 206 is inserted into the socket 204, the first encircling member 212 is attached to the connector 206 in such a manner that a bottom wall 212A of the first encircling member 212 is brought into contact with a bottom surface 206A the connector 206. In this state, an engagement depression 216 formed in a third upright wall 212D of the first encircling member 212 is fitted into one of a number of grooves 206C in a proximal end region of the connector 206. Further, in a state after the connector 206 is inserted into the socket 204, a protrusion finger 214E of the second encircling member 214 is inserted below a latching-flap 210 in such a manner as to extend along a top surface 206A of the connector 206 while being in contact with the top surface 206A. In this state, based on the locking of the lock 209, the first encircling member 212 and the second encircling member 214 lock the connector 206 at the inserted position in the socket 204, as shown in FIG. 19. As shown in FIG. 18, five of the engagement depressions 216 are formed in the third upright wall 212D of the first encircling member 212. For example, the second encircling member 214 includes five of the protrusion fingers 214E, as shown in FIG. 18. Thus, the five protrusion fingers 214E allow five of LAN cables to be simultaneously locked relative to five of the sockets 204.

Figure 20:
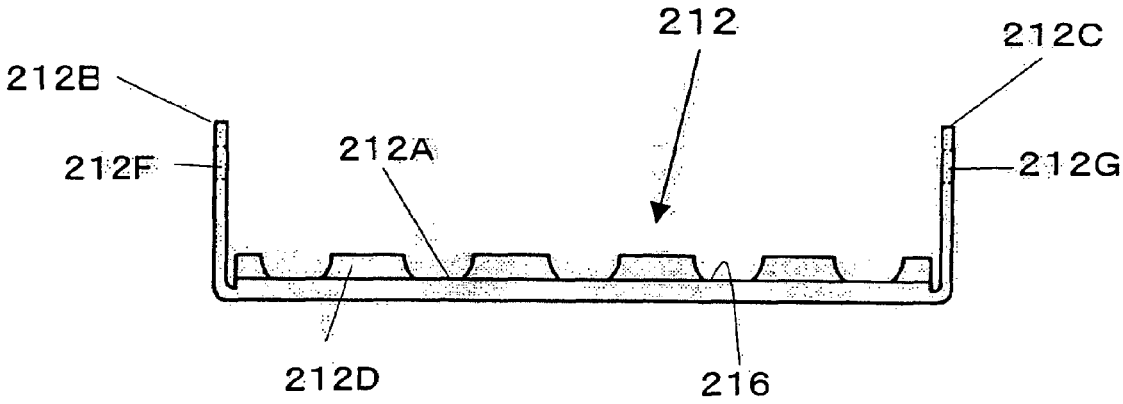
FIG. 20 is a front view of a first encircling member of the lock assembly illustrated in FIG. 18.

A shape of the first encircling member 212 will be described in detail. FIG. 20 is a front view of the first encircling member 212. The first encircling member 212 integrally has a bottom wall 212A adapted to come into contact with the bottom surface 206B of the connector 206, the first upright wall 212B standing upright from a first one of axially-extending laterally opposed edges of the bottom wall 212A, the second upright wall 212C standing upright from the other or second edge of the bottom wall 212A, and the third upright wall 212D standing upright from a rear edge of the bottom wall 212A extending in a direction orthogonal to the axial direction.

As shown in FIG. 20, the upright wall 2111B has the same height and width as those of the second upright wall 212C standing upright from the second edge. The first upright wall 212B is formed with the lock hole 212F for allowing the lock rod 208A of the lock 208 to penetrate therethrough, and the second upright wall 212C is formed with the lock hole 212G for allowing the lock rod 209A of the lock 209 to penetrate therethrough.

The third upright wall 212D is formed with the engagement depressions 216. Specifically, in the state after the lock assembly 210 is attached to the connector 206, each of the engagement depressions 216 is fitted into and engaged with one of a number of grooves 206C formed in a rear region of the connector 206, as shown in FIG. 19. The engagement depression 216 engaged with the groove 206C prohibits the first encircling member 212 (or the entire lock assembly 210) from being moved in the axial direction. For example, the five the engagement depressions 216 can lock up to five LAN cables.

Figure 21:
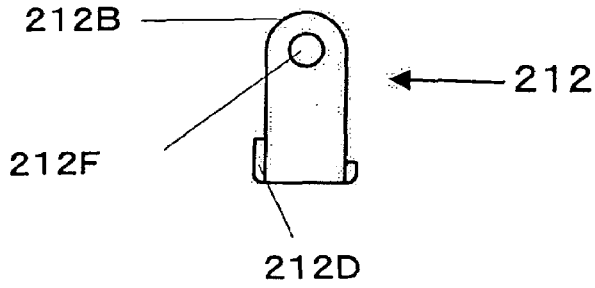
FIG. 21 is a right side view of the first encircling member illustrated in FIG. 20.

FIG. 21 is a side view of the first encircling member 212. The first upright wall 212B is formed with the lock hole 212F for allowing the lock rod 208A of the lock 208 to penetrate therethrough. The third upright wall 212D stands upright along the first upright wall 212B.

Figure 22:
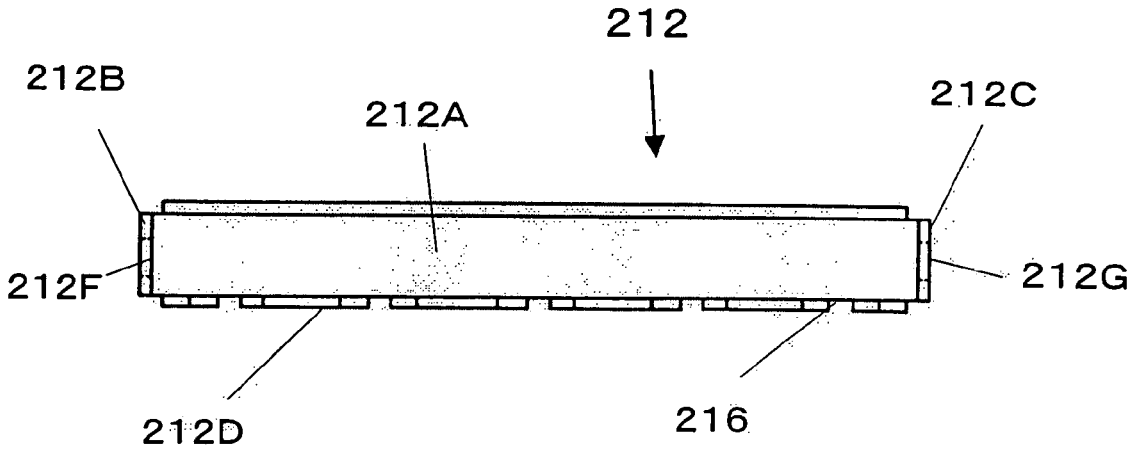
FIG. 22 is a top plan view of the first encircling member illustrated in FIG. 20.

FIG. 22 is a top plan view of the first encircling member 212. The first and second upright walls 212B, 212C are formed, respectively, along the first and second edges of the bottom wall 212A. The third upright wall 212D formed with the engagement depressions 216 is formed along one edge connecting between the first and second upright walls 212B, 212C.

Figure 23:
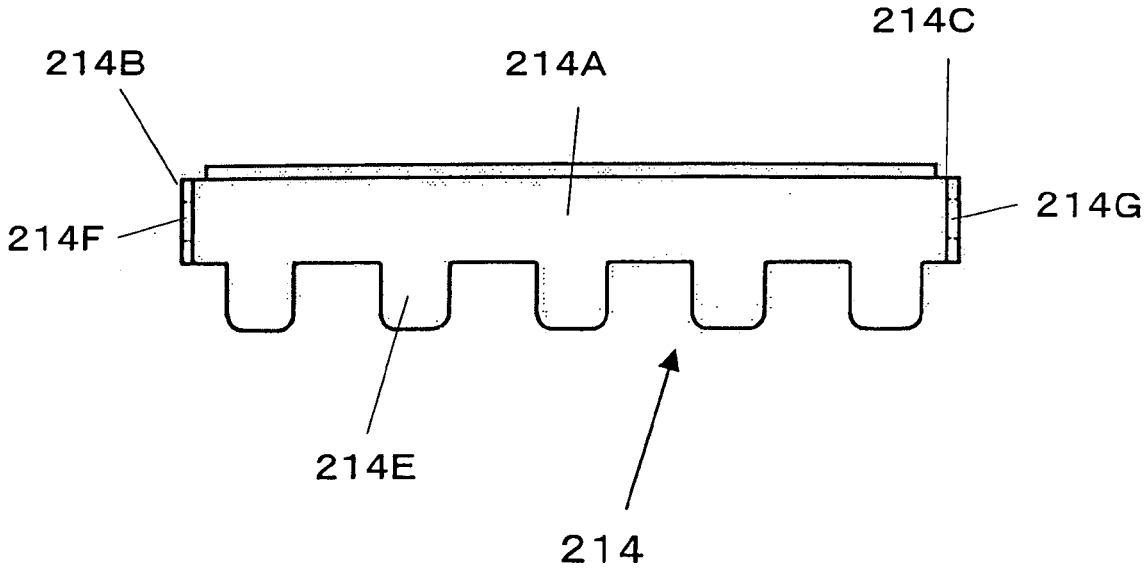
FIG. 23 is a top plan view of a second encircling member of the lock assembly illustrated in FIG. 18.

A shape of the second encircling member 214 will be described in detail below. FIG. 23 is a top plan view of the second encircling member 214. The second encircling member 214 integrally has the plate-shaped body 214A, the first upright wall 214B standing upright from a first one of axially-extending laterally-opposite edge of the body 214A, the second upright wall 214C standing upright from the other or second edge of the body 214A, and the protrusion finger 214E extending frontward from a front edge of the body 214A. In this embodiment, five of the protrusion fingers 214E are formed. Thus, the five protrusion fingers 214E allow five of LAN cables to be simultaneously locked relative to five of the sockets 204.

Figure 24:
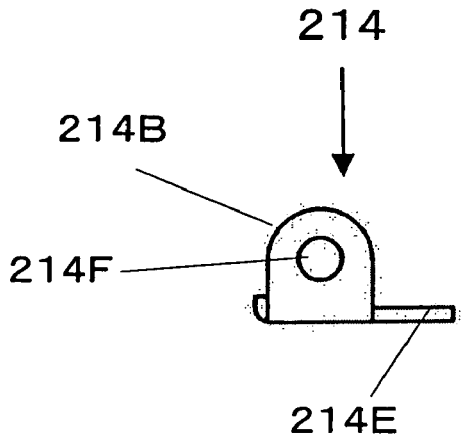
FIG. 24 is a side view of the second encircling member illustrated in FIG. 23.

FIG. 24 is a side view of the second encircling member 214. The first upright wall 214B is formed with the lock hole 214F for allowing the lock rod 209A of the lock 209 to penetrate therethrough. The protrusion finger 214E protrudes from a part of the body 214A at the bottom wall of the first upright wall 214B.

Figure 25:
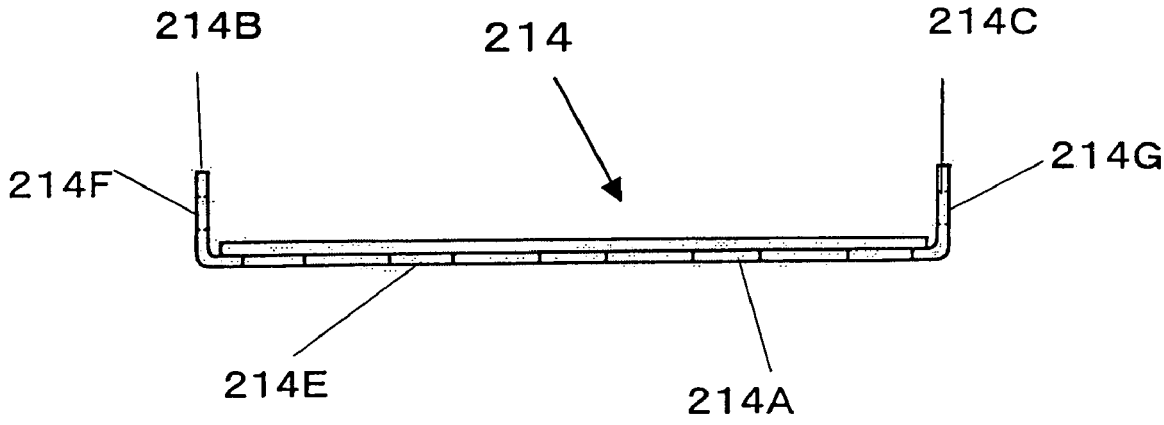
FIG. 25 is a front view of the second encircling member illustrated in FIG. 24.

FIG. 25 is a front view of the second encircling member 214. The upright wall 214B has the same height and width as those of the second upright wall 214C standing upright from the second edge. The first upright wall 214B is formed with the lock hole 214F for allowing the lock rod 208A of the lock 208 to penetrate therethrough, and the second upright wall 214C is formed with the lock hole 214G for allowing the lock rod 209A of the lock 209 to penetrate therethrough.

Figure 26:
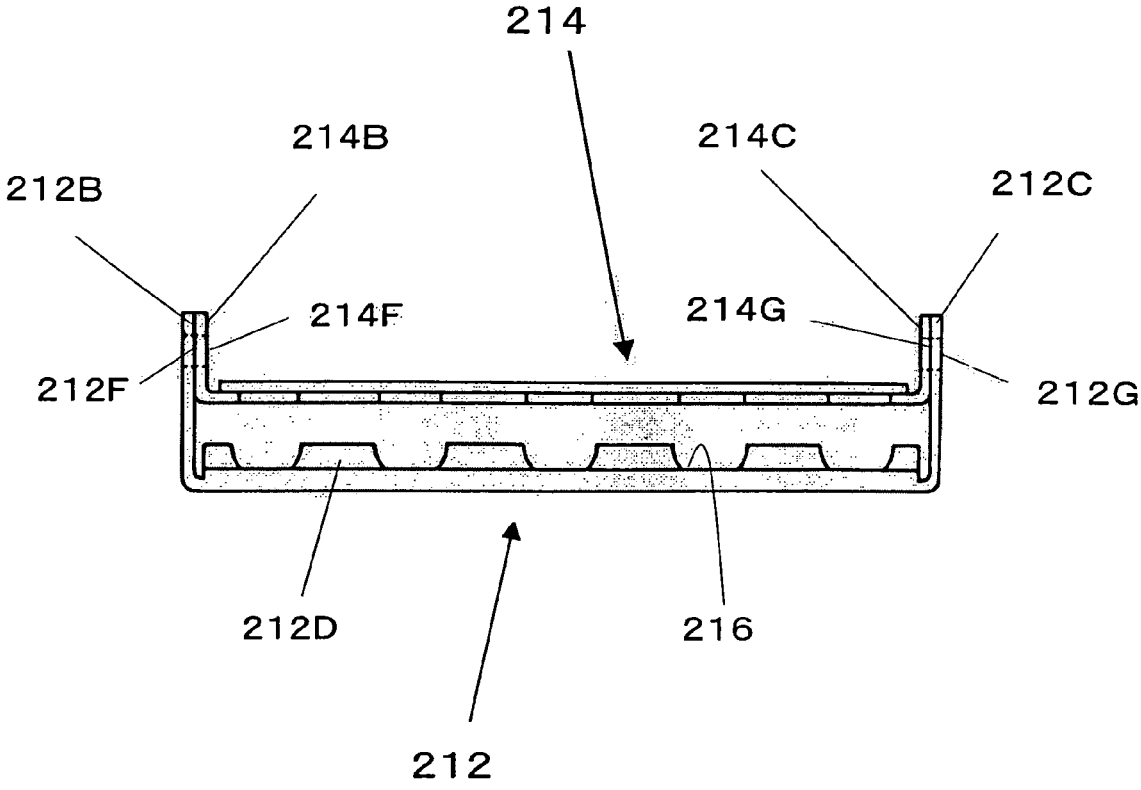
FIG. 26 is a front view showing the first and second encircling members of the lock assembly illustrated in FIG. 18, just before being assembled together.

With reference to FIG. 26, a process of assembling the first and second encircling members 212, 214 together will be described below.

FIG. 26 is a front view of the first encircling member 212 and the second encircling member 214 assembled together. The second encircling member 214 is attached to the first encircling member 212 from above in such a manner that respective upright walls of the first and second encircling members 212, 214 are partly superimposed on each other. Specifically, the first and second encircling members 212, 214 are assembled in such a manner that the lock hole 212F of the first upright wall 212B of the first encircling member 212 is located at the same position as that of the lock hole 214F of the first upright wall 214B of the second encircling member 214, and the lock hole 212G of the first upright wall 212C of the first encircling member 212 is located at the same position as that of the lock hole 214G of the first upright wall 214C of the second encircling member 214.

Then, this lock assembly 210 is attached such that, in a state after a plurality of connectors 206 are inserted, respectively, into a plurality of sockets 204, the bottom wall 212A of the first encircling member 212 is brought into contact with the bottom surface 206B of the connector 206, and the first and second upright walls 212B, 212C of the first encircling member 212 are located outside the outermost two of five connectors inserted into five sockets, respectively. In this state, each of the engagement depressions 216 formed in the third upright wall 212D of the first encircling member 212 is fitted into one of the grooves 206C in the proximal end region of the connector 206. Further, in a state after the five connectors 206 are inserted, respectively, into the five sockets 204, each of the protrusion fingers 214E of the second encircling member 214 is inserted below the latching-flap 210 in such a manner as to extend along the top surface 206A of a corresponding one of the connector 206 while being in contact with the top surface 206A. In this state, the first encircling member 212 and the second encircling member 214 constituting the lock assembly 210 are positioned as shown in FIG. 26 (in FIG. 25, the five connectors 206 are omitted). Thus, based on the locking of the locks 208, 209, the first encircling member 212 and the second encircling member 214 lock the connectors 206 at respective inserted positions in the sockets 204.

Figure 27:
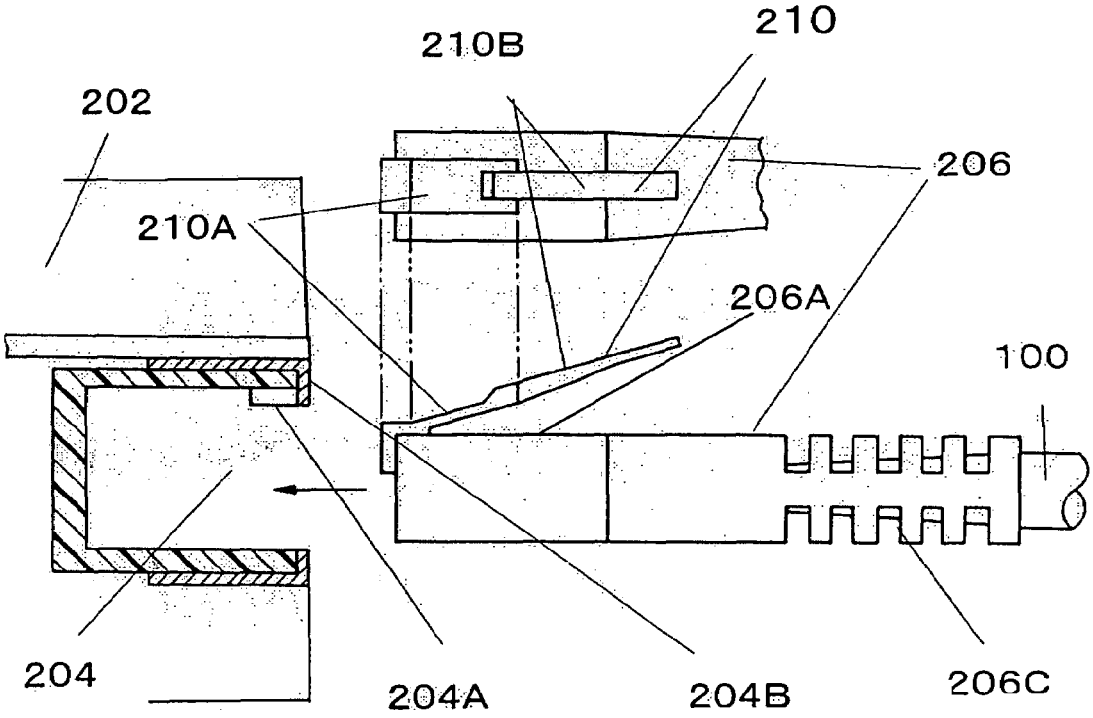
FIG. 27 is a partially sectional view showing an operation for inserting into a socket a connector to be locked by the lock assembly illustrated in FIG. 18.

For better understanding, an operation for inserting a plurality of connectors 206, respectively, into a plurality of sockets 204 in a normal state (or without using the lock assembly 210 according to the second embodiment) will be described below with reference to FIGS. 27 and 28. FIG. 27 is a partially sectional view showing the connector 206 and the socket 204 provided to a hub 202. A flap 210 is integrally fixed onto a front end of a top surface 206A of the connector 106, and designed to be elastically deformed by applying a pressing force thereto.

In the flap 110, an anchor end region 210A is formed to have a relatively wide width, and a distal end region 210B extending from the anchor end region 210A is formed to have a width less than that of the anchor end region 210A. That is, the flap 110 has a two-step structure in terms of width, and a step is formed at an approximately midpoint thereof.

Figure 28:
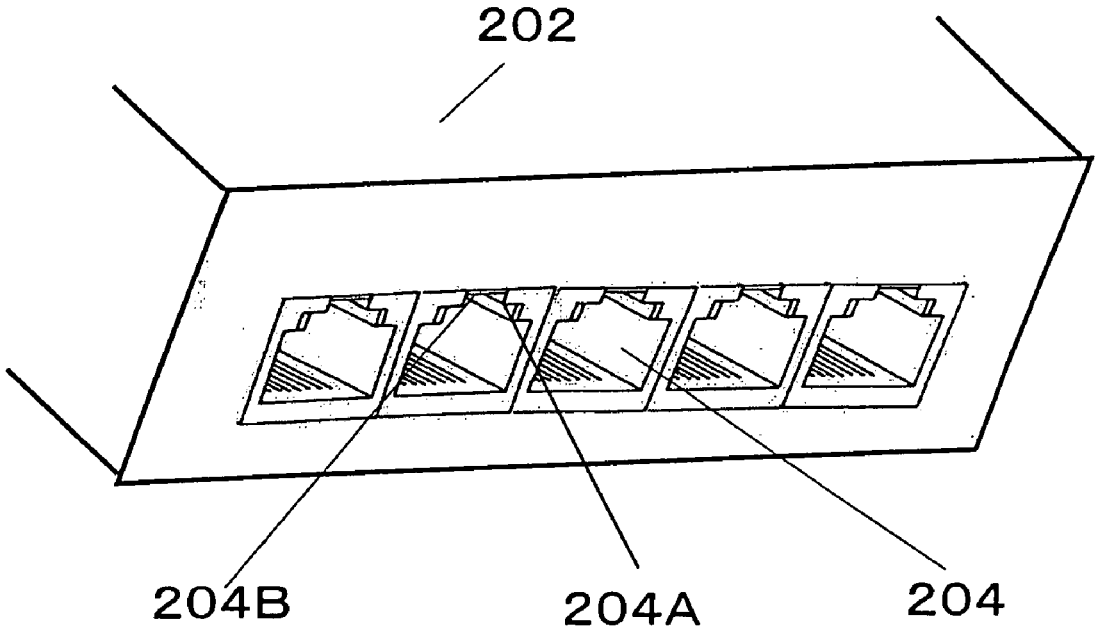
FIG. 28 is a fragmentary perspective view showing the structure of the socket illustrated in FIG. 27.

FIG. 28 shows the plurality of sockets 204 provided to the hub 202. An upper edge of an opening in each of the sockets 204 is formed with a first groove 204A having a shape which allows the wide anchor end region 210A of the flap 210 to be inserted thereinto. An upper wall surface of the first groove 204A is formed with a second groove 204B having a shape which allows only the narrow distal end region 210B to be inserted thereinto while precluding the wide anchor end region 210A of the flap 210 from being inserted thereinto. The second groove 204B is formed to have a thin thickness in the axial direction so as to define a so-called engagement shoulder.

The socket 204 has the above structure. Thus, as shown in FIG. 27, when the connector 206 is inserted into the socket 204, the wide anchor end region 210A of the flap 210 is gradually moved downward by the upper wall while passing through the first groove 204A. Then, when the step as a transitional point to the narrow distal end region 210B of the flap 210 passes through the shoulder, the narrow distal end region 120B fallingly enters into the second groove 204B based on its own elastic force, and thereby the step of the flap 210 is engaged with the shoulder. The relationship in engagement between the step and the shoulder allows an inserted position of the connector 206 in the socket 204 to be latched in a non-disengageable manner.

In an operation for pulling out or removing the connector 206 from this inserted position, the flap 210 is pressed down against it own elastic force. According to this pressing-down operation, the engagement between the step and the shoulder is released so as to allow the connector 206 to be removed from the socket 204. That is, the latch of the connector 206 relative to the socket 204 is released. In this released state, the connector 206 is pulled out of the socket 204 and removed from the socket 204.

When the lock assembly 210 according to the second embodiment is used in the above connectors 206 and sockets 204, each of the protrusion fingers 214E integrally formed with the second encircling member 14 hinders the flap 210 from being pressingly moved downward so as to prevent the latch from being released due to pressing-down of the flap 210. Thus, the connector 206 will be kept at the inserted position in the socket 204 (or locked to the socket 204) to reliably prohibit the connector 206 from being removed from the socket 204.

As described above in detail, the lock assembly 210 according to the second embodiment can be used for allowing the connector 206 inserted into the socket 204 of the hub 202 to be locked at an inserted position in the socket 204 so as to obtain an effect of being able to effectively fasten the LAN cable 100 to the hub 220. This makes it possible to effectively prevent the theft of a PC connected to the LAN cable 100 together with the LAN cable.

Particular, in a PC using the lock assembly 210 according to the second embodiment, a person who attempts to move out the PC (enforcedly move the PC 102 from its setup location) has no choice but to cut off the LAN cable 100. For example, when the LAN cable 100 is cut off using a metal cutter, the cutter blade is brought into contact with cords in the LAN cable 100 to cause short-circuiting, and this short-circuiting phenomenon will be detected by a server connected to which the LAN cable 100. This allows the server to recognize an unintended cutoff of the LAN cable 100. Further, even is the short-circuiting phenomenon is not detected, the LAN cable 100 after being cut off has codes in an open state, and the open state will be detected by the server. This also allows the server to recognize an unintended cutoff of the LAN cable 100.

Thus, the lock assembly 210 according to the second embodiment makes it possible to effectively prevent the theft of a PC including improperly moving the PC to other location. Specifically, as compared with the conventional technique designed to fasten a PC to its setup location using the locking coupling cord, such as wire, the lock assembly 210 according to the second embodiment can obtain an antitheft effect based on locking the connector 206 in a state after being mechanically connected to the hub 202 (or prohibiting the connector in a state after being mechanically connected to the hub 202 from being removed) without bonding any other additional member to a housing of a PC). Thus, this lock assembly 210 is highly advantageous.

Further, in the second embodiment, the plurality of LAN-cable connectors 206 inserted into the hub can be simultaneously locked relative to the sockets 204 to prohibit the LAN cables from being removed from the hub. This can be expected to provide an effect of being able to prevent occurrence of troubles, system failures, to be caused by intentionally or erroneously pulling out or removing a LAN-cable connector from the hub or by intentionally or erroneously inserting a wrong LAN-cable connector into a socket of the hub.

In addition to the PC antitheft effect, the lock assembly 210 according to the second embodiment can be used for providing an effect of being able to prevent occurrence of troubles in a local area network or intranet and provide enhanced security.

It is understood that the present invention is not limited to the above embodiment, but various modifications and changes may be made therein without departing from spirit and scope of the invention.

For example, while the lock assembly according the second embodiment employs two locks, the present invention is not limited thereto, but the shape of the first and/or second encircling members may be modified to use a single lock.

Further, while the number of hub sockets or LAN-cable connectors in the second embodiment is five, it is understood that the present invention is not limited such a number.

Third Embodiment

Figure 29:
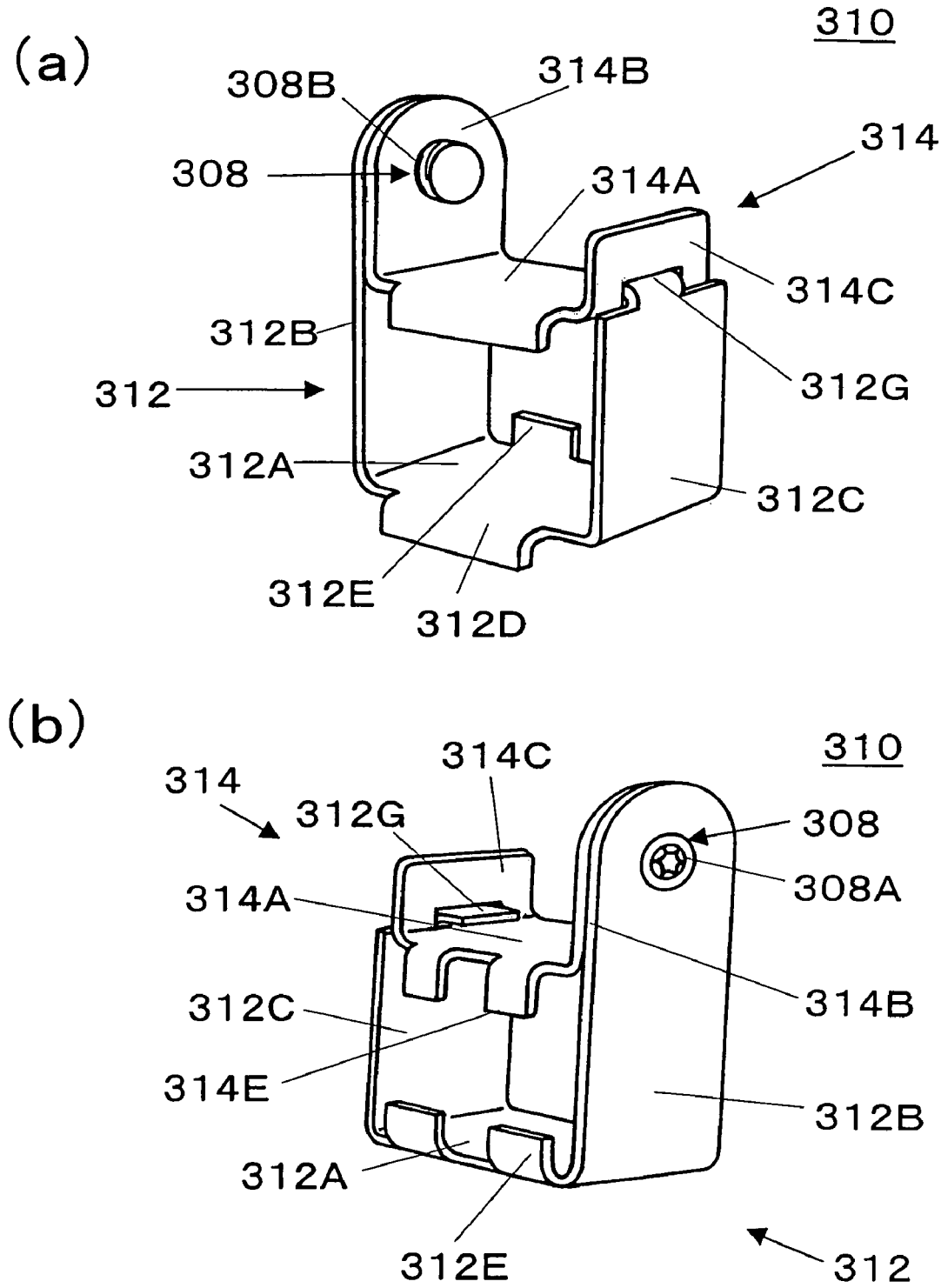
FIG. 29 is a perspective view showing a lock assembly according to a third embodiment of the present invention.
Figure 30:
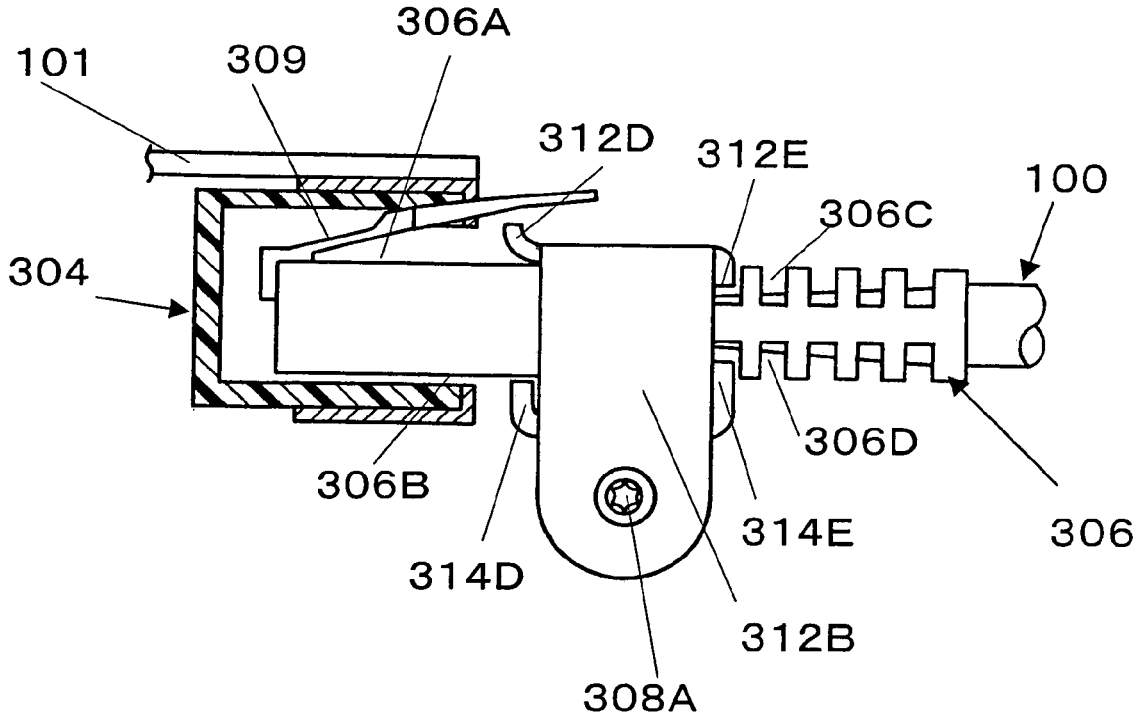
FIG. 30 is a partially sectional view showing a connector which is inserted in a socket and locked by the lock assembly illustrated in FIG. 29.

With reference to FIGS. 29 to 34, a lock assembly according to a third embodiment of the present invention will be described in detail. FIG. 29 is a perspective view showing the lock assembly according to the third embodiment, wherein FIG. 29(*a*) is a perspective view of the lock assembly, viewing from a certain direction, and FIG. 29(*b*) is a perspective view of the lock assembly, viewing from a direction opposite to that in FIG. 29(*a*). FIG. 30 is a partially sectional view showing a connector which is inserted in a socket and locked by the lock assembly according to the third embodiment As shown in FIGS. 29 and 30, the lock assembly 310 comprises a first encircling member 312 and a second encircling member 314. This lock assembly 310 is designed to be attached to a LAN-cable connector (hereinafter referred to simply as "connector") 306 so as to lock the connector 306 at an inserted position in a socket 304 of a PC 101.

Specifically, the lock assembly 310 is attached to the connector 306, and fastened by a set screw 308 so as to lock the connector 306 relative to the socket 304. Further, the set screw 308 is taken out to allow he lock assembly 310 to be detached from the connector 306 so as to allow the connector 306 to be pulled out of or removed from the socket 304. That is, the lock assembly 310 is operable to lock the connector 306 at the inserted position in the socket 304 so as to prohibit the connector 306 from being moved from a PC and thereby prevent theft of the PC.

With reference to FIGS. 29(*a*) and 29(*b*), the lock assembly 310 will be described in detail below. The second encircling member 314 is attached to be superimposed on an inner upper portion of the first encircling member 312 (the term "upper" means the upper side in figures). In the first encircling member 312, a first upright wall 312B and a second upright wall 312C stand upright, respectively, from opposite ends of a bottom wall 312A. A first upright wall 314B and a second upright wall 314 C standing upright, respectively, from opposite ends of a bottom wall 314A of the second encircling member 314, are disposed inside, respectively, the first upright wall 312B and the second upright wall 312C, in a superimposed manner. A protrusion finger 312G at an upper end of the second upright wall 312C of the first encircling member 312 is fitted into and fixed to a through-hole 314G formed in the second upright wall 314 C of the second encircling member 314. A position of a loose hole formed in the first upright wall 312B of the first encircling member 312 is aligned with a position of a screw hole formed in the first upright wall 314B of the second encircling member 314. Thus, the set screw 308 can be inserted from the side of the loose hole to the screw hole to fasten the first encircling member 312 and the second encircling member 314 together. A screw head 308A is formed with a groove for allowing a tool to be inserted thereto so as to drive the screw. A threaded portion 308B is a shank of the screw 308, and a thread is formed at a constant pitch.

With reference to FIG. 30, the lock assembly 310 will be described in detail below. FIG. 30 is a partially sectional view of the lock assembly 310 comprising the first encircling member 312 and the second encircling member 314 attached to the connector 306, viewing from the side of the upright wall 312B. In a state after the connector 306 is inserted into the socket 304, the first encircling member 312 is attached to the connector 306 in such a manner that the bottom wall 312A of the first encircling member 312 is brought into contact with a top surface 306A the connector 306. In this state, a first engagement finger 312 E of the first encircling member 312 is fitted into one of a number of grooves 306C in a proximal end region of the connector 306. Further, a restriction finger 312D of the first encircling member 312 is inserted below a latching-flap 309 of the connector 306. The second encircling member 314 is attached such that the protrusion finger 312G at the upper end of the second upright wall 312C of the first encircling member 312 is fitted into the through-hole 314G formed in the second upright wall 312C of the second encircling member 314, and a second engagement finger 314E of the second encircling member 314 is fitted into one of a number of bottom grooves 306D of the proximal end region of the connector 306.

In this state, as shown in FIG. 30, the first encircling member 312 and the second encircling member 314 constituting the lock assembly 310 are fastened together by the set screw 308 to lock the connector 306 inserted into the socket 304. As shown in FIG. 29(*b*), each of the first engagement finger 312E of the first encircling member 312 and the second engagement finger 314E of the second encircling member 314 has two protrusions. The two protrusions are designed to sandwich the upper groove 306C and the bottom groove 306D in the proximal end region of the LAN-cable connector 306 therebetween.

Figure 31:
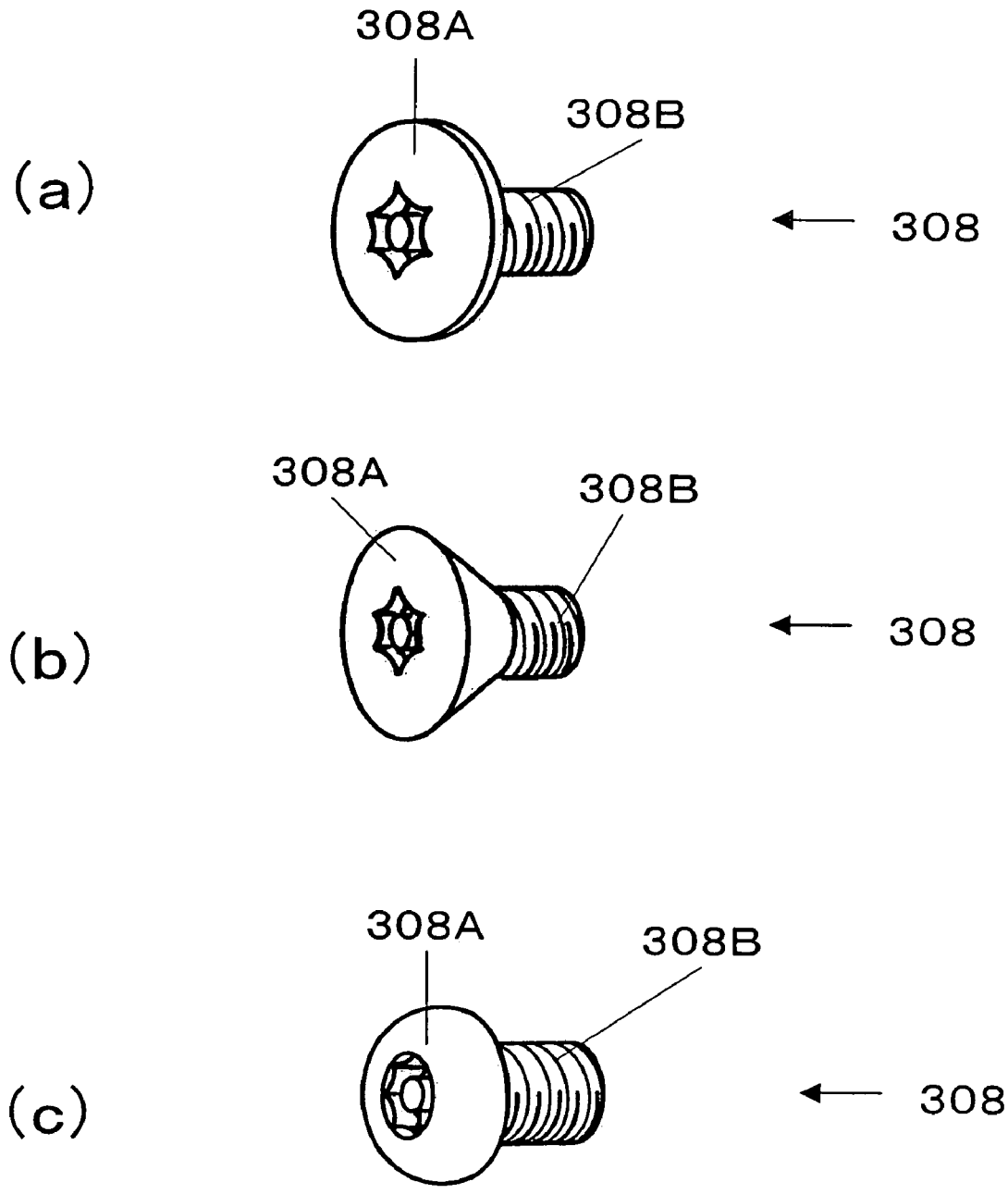
FIG. 31 is a perspective view showing shapes of various types of special screws.

FIG. 30 shows an example of the set screw 308 for locking the first encircling member 312 and the second encircling member 314. The set screw 308 is a special screw which cannot be handled using a normal tool, but only using a dedicated tool owned by a PC maintenance staff. FIG. 31(*a*) shows a flathead screw, and FIG. 31(*b*) shows a countersunk tamper-proof screw. FIG. 31(*c*) shows a round tamper-proof screw. In each of the set screws, a screw head 308A for use in driving and loosening the screw is formed with an extremely special 3-dimensional dent, and can be driven using a dedicated tool to take out the set screw 308. These special screws can be used in the above lock assembly 310 to allow the lock assembly 310 to be detached only using a special tool owned by a PC maintenance staff. Thus, this is highly advantageous to PC antitheft.

Figure 32:
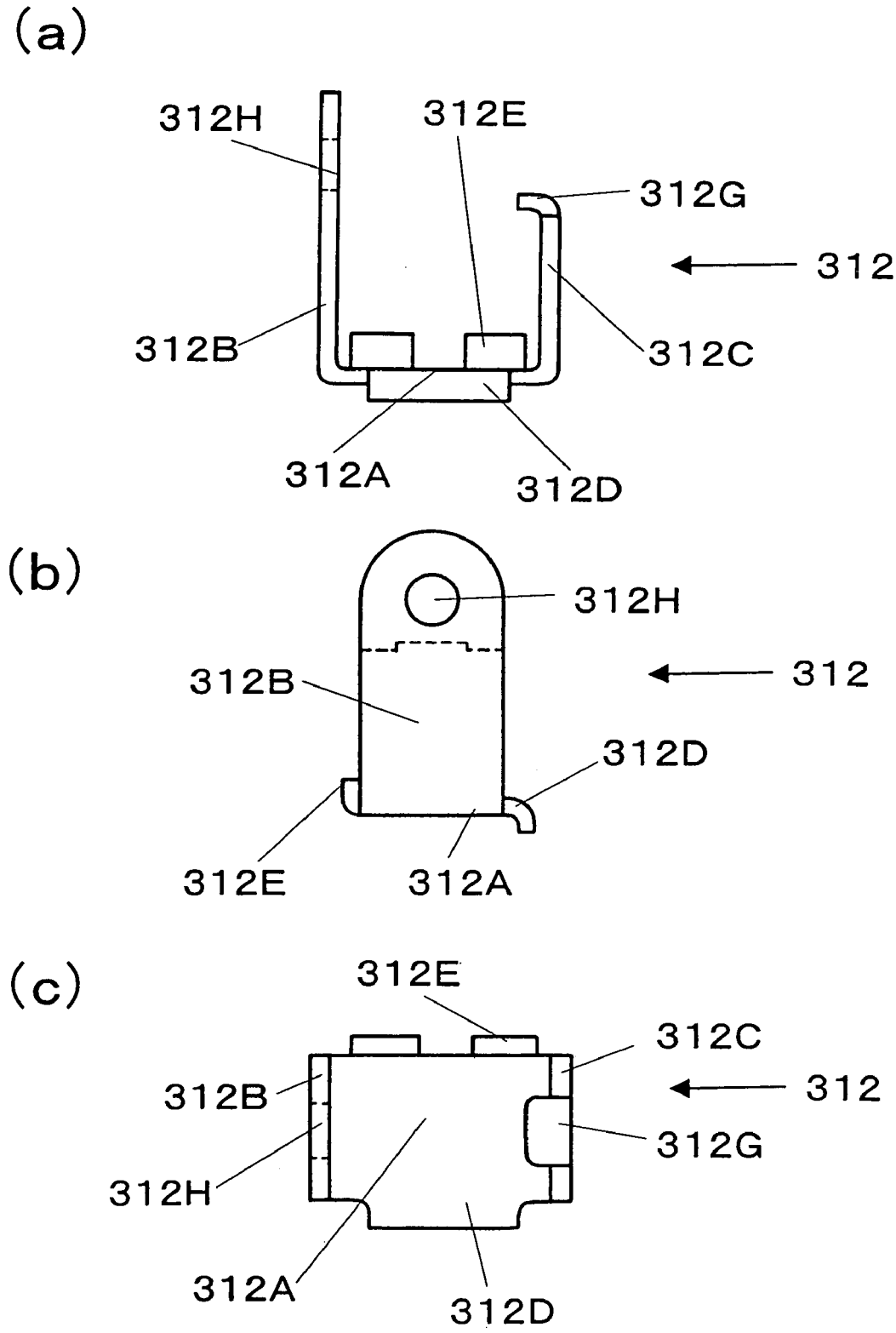
FIG. 32 illustrates a first encircling member of the lock assembly illustrated in FIG. 29.

FIG. 32 shows the detail of a shape of the first encircling member 312, wherein FIGS. 32(*a*), 32(*b*) and 32(*c*) are, respectively, a front view, a side view and a top plan view of the first encircling member 312. The first encircling member 312 integrally has the bottom wall 312A adapted to come into contact with the top surface 306A of the connector 306, the first upright wall 312B standing upright from a first one of axially-extending laterally opposed edges of the bottom wall 312A, the second upright wall 312C standing upright from the other or second edge of the bottom wall 312A, the third upright wall 312E standing upright from a rear edge of the bottom wall 312A extending in a direction orthogonal to the axial direction, and the restriction finger 312D standing upright from a front edge of the bottom wall 312A extending in a direction orthogonal to the axial direction. The protrusion finger 312G is formed at the upper end of the second upright wall 321C. The restriction finger 312D is attached to be inserted below the latching-flap 309 of the connector 306. The loose hole 312H is formed in the first upright wall 312B to allow the set screw 308 to penetrate therethrough. This loose hole 312H is a hole for allowing the set screw to loosely pass therethrough, and therefore formed to have a diameter slightly greater than the threaded portion 308B of the set screw 308.

In a state after the lock assembly member 310 is attached to the connector 306, the first engagement finger 312E is fitted into and engaged with the upper groove 306C formed in a rear region of the connector 306. The first engagement finger 312E engaged with the upper groove 306C prohibits the first encircling member 312 (or the entire lock assembly 310) from being moved in the axial direction. The first engagement finger 312E has two protrusions designed to sandwich the upper groove 306C in the proximal end region of a single LAN-cable connector 306 therebetween.

Figure 33:
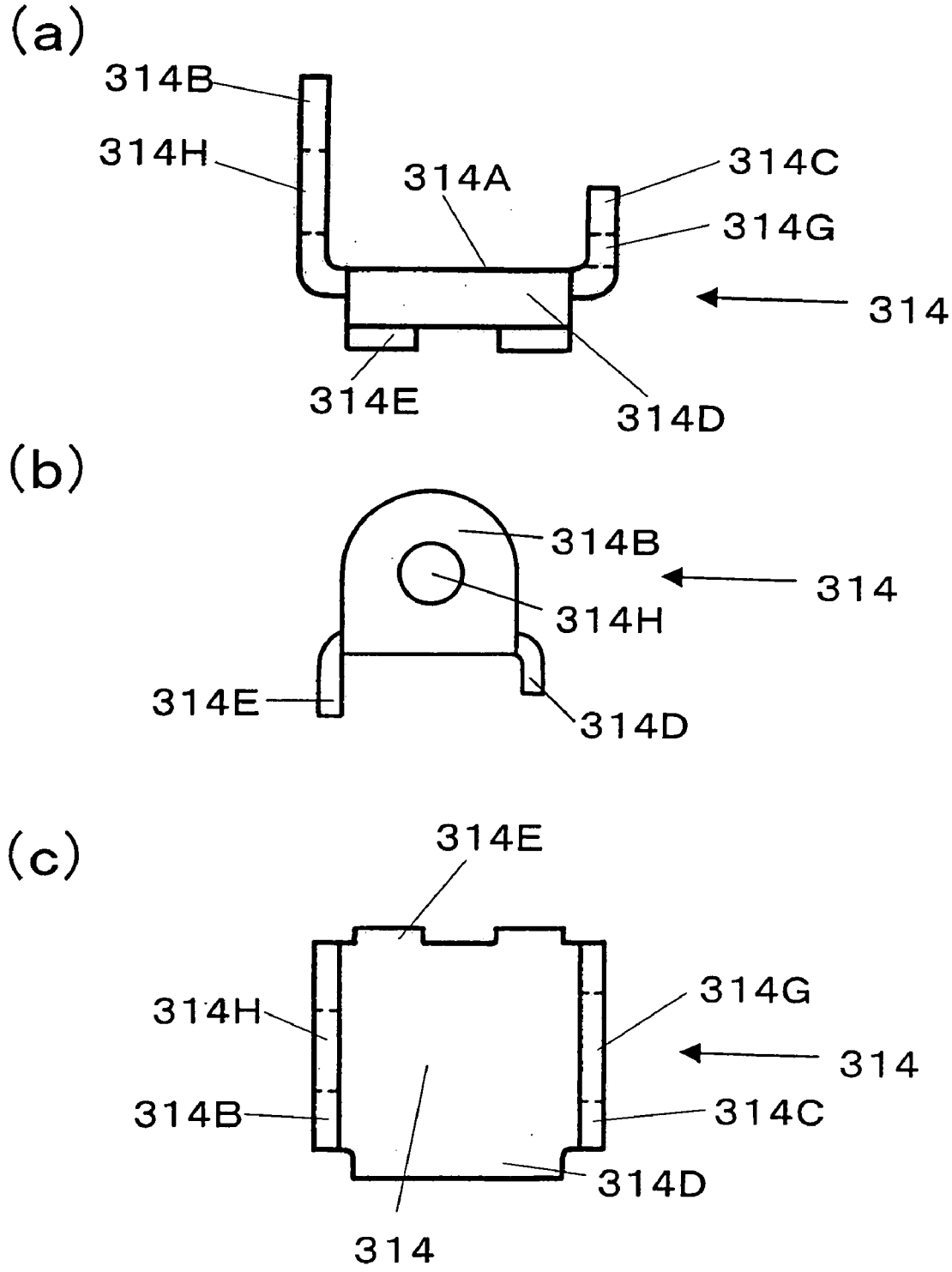
FIG. 33 illustrates a second encircling member of the lock assembly illustrated in FIG. 29.

FIG. 33 shows the detail of a shape of the second encircling member 314, wherein FIGS. 33(*a*), 33(*b*) and 33(*c*) are, respectively, a front view, a side view and a top plan view of the second encircling member 314. The second encircling member 314 integrally has the bottom wall 314A, the first upright wall 314B standing upright from one edge of the bottom wall 314A, the second upright wall 314C standing upright from another edge of the bottom wall 314A, the second engagement finger 314E standing upward from a front edge of the bottom wall 314A, and a pressing finger 314D extending from an edge on the opposite side of the bottom wall 314A. In this embodiment, five of the protrusion fingers 214E are formed. Thus, the five protrusion fingers 214E allow five of LAN cables to be simultaneously locked relative to five of the sockets 204. The second engagement finger 314E has two protrusions designed to sandwich the bottom groove 306D in the proximal end region of a single LAN-cable connector 306 therebetween. The pressing finger 314D is designed to protrude and come into contact with a bottom surface 306B of the connector 306. The first upright wall 314B is formed with the screw hole 314H adapted to be threadingly engaged with the set screw 308. This screw hole 314H is a hole for being engaged with the set screw 308 after penetrating the loose hole 312H of the first encircling member 312, and internally threaded in conformity to a thread pitch of the threaded portion 308B. The second upright wall 314C is formed with the through-hole 314G With reference to FIG. 34, a process of assembling the first and second encircling members 312, 314 together will be described below.

Figure 34:
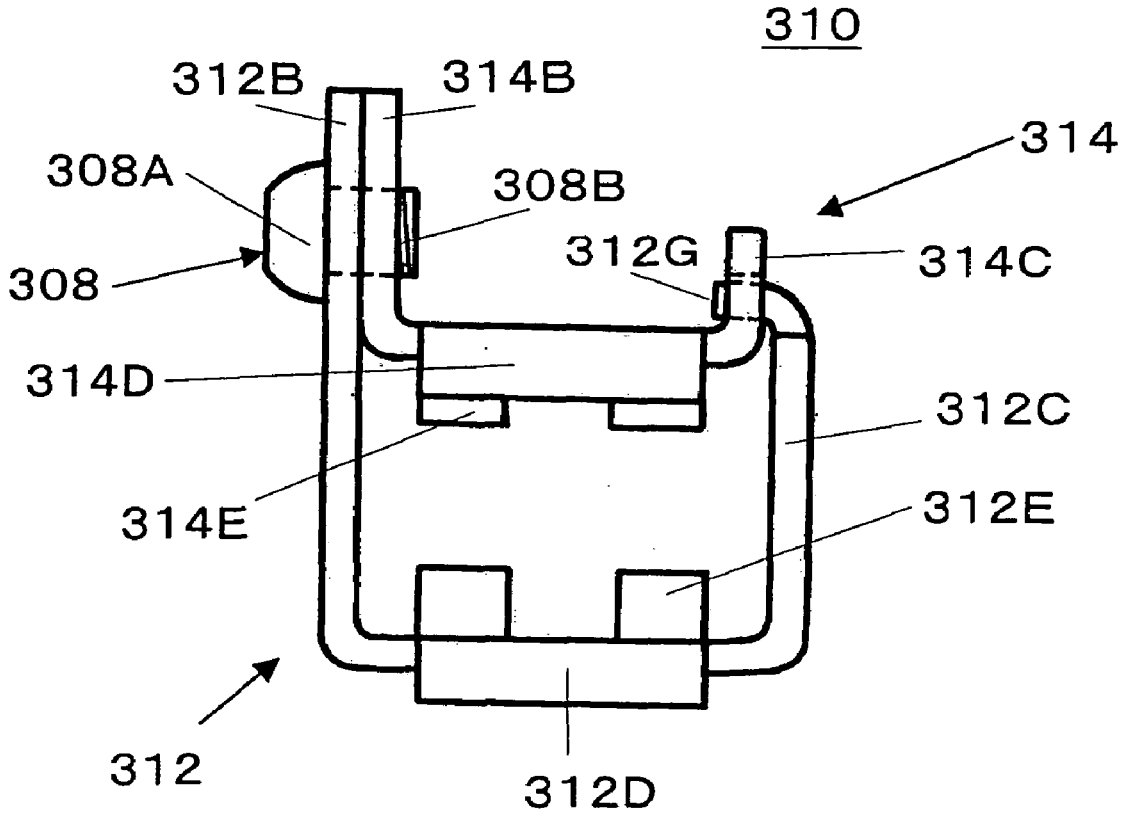
FIG. 34 is a top plan view showing the first and second encircling members after being assembled together.

FIG. 34 is a front view of the first encircling member 312 and the second encircling member 314 assembled together. The second encircling member 314 is attached to the first encircling member 312 from above in such a manner that respective upright walls of the first and second encircling members 312, 314 are partly superimposed on each other. Specifically, the protrusion finger 312G of the second upright wall 312C of the first encircling member 312 is fitted into the through-hole 314G of the second upright wall 314C of the second encircling member 314. Then, the loose hole 312H of the first upright wall 312B of the first encircling member 312 is arranged at the same position as that of the screw hole 314H of the first upright wall 314B of the second encircling member 314, and the first upright wall 312B of the first encircling member 312 and the first upright wall 314B of the second encircling member 314 are fastened and assembled together using the set screw 308.

Then, the lock assembly 310 is attached such that, in a state after the connector 306 is inserted into the sockets 304, the first and second upright walls 312B, 312C of the first encircling member 312 are located under the connector 306 so as to allow the bottom wall 312A of the first encircling member 312 to be brought into contact with the top surface 306A of the connector 306. In this state, the first engagement finger 312E of the first encircling member 312 is fitted into the upper groove 306C in the proximal end region of the connector 306, and the second engagement finger 314E of the second encircling member 314 is fitted into the bottom groove 306D in the proximal end region of the connector 306. Further, in the state after the connector 306 is inserted into the socket 304, the restriction finger 312D is inserted below the latching-flap 310.

In the lock assembly 310 attached in the above manner, the first upright wall 312B of the first encircling member 312 and the first upright wall 314B of the second encircling member 314 are fastened together using the set screw 308, and thereby the connector 306 inserted in the socket 304 is locked.

As mentioned above detail, the lock assembly 310 according to the third embodiment has the same effects as those the first embodiment. Further, the protrusion finger 14E in the first embodiment is improved as in the restriction finger 312D in the third embodiment to achieve downsizing. Furthermore, in the third embodiment, the set screw 308 is employed in place of the lock 108 in the first embodiment to facilitate downsizing, and formed as a special screw incapable of being handled using a normal tool so as to achieve antitheft effect. Thus, the lock assembly 310 is highly advantageous.

Fourth Embodiment

Figure 35:
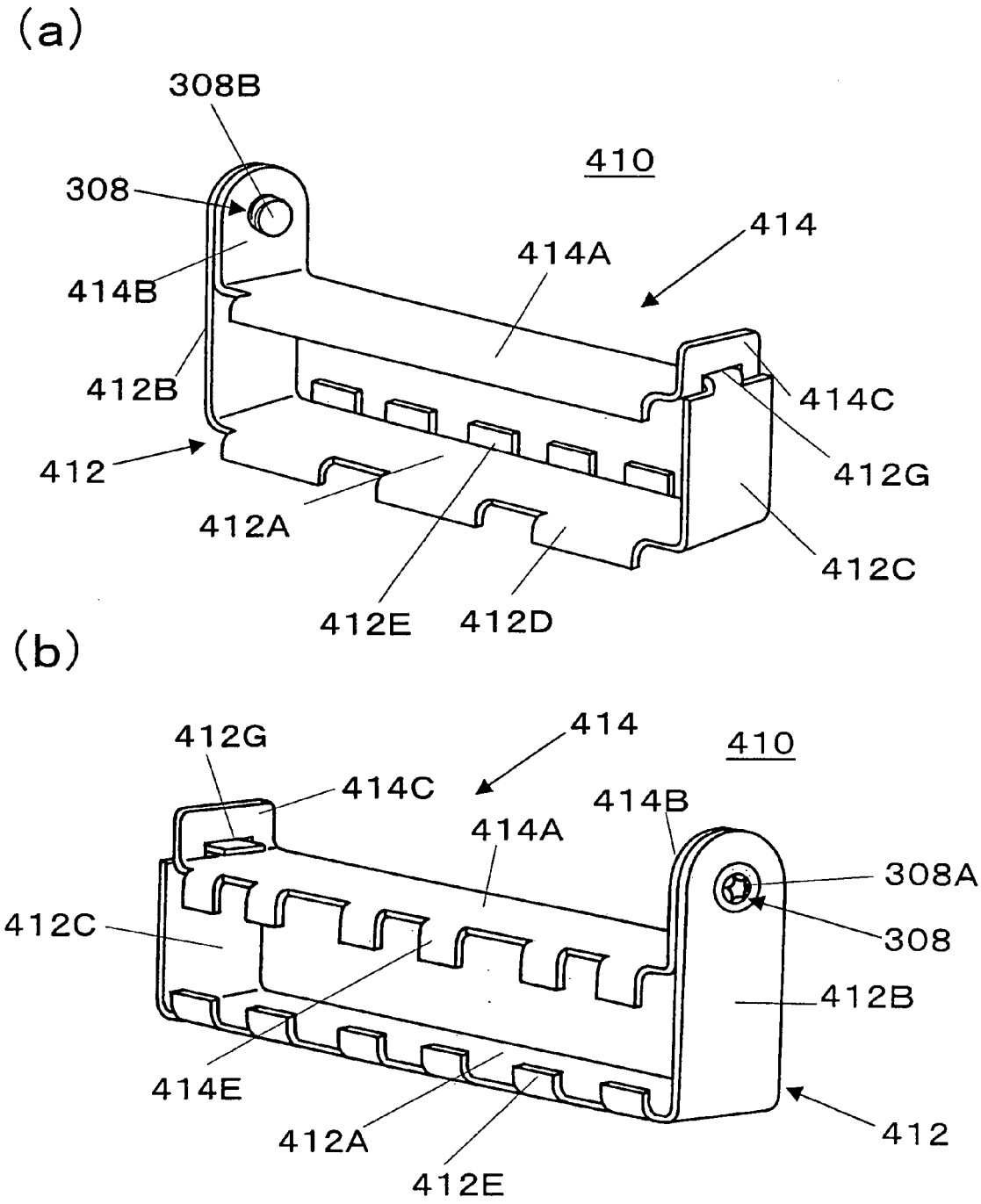
FIG. 35 is a perspective view showing a lock assembly according to a fourth embodiment of the present invention.
Figure 36:
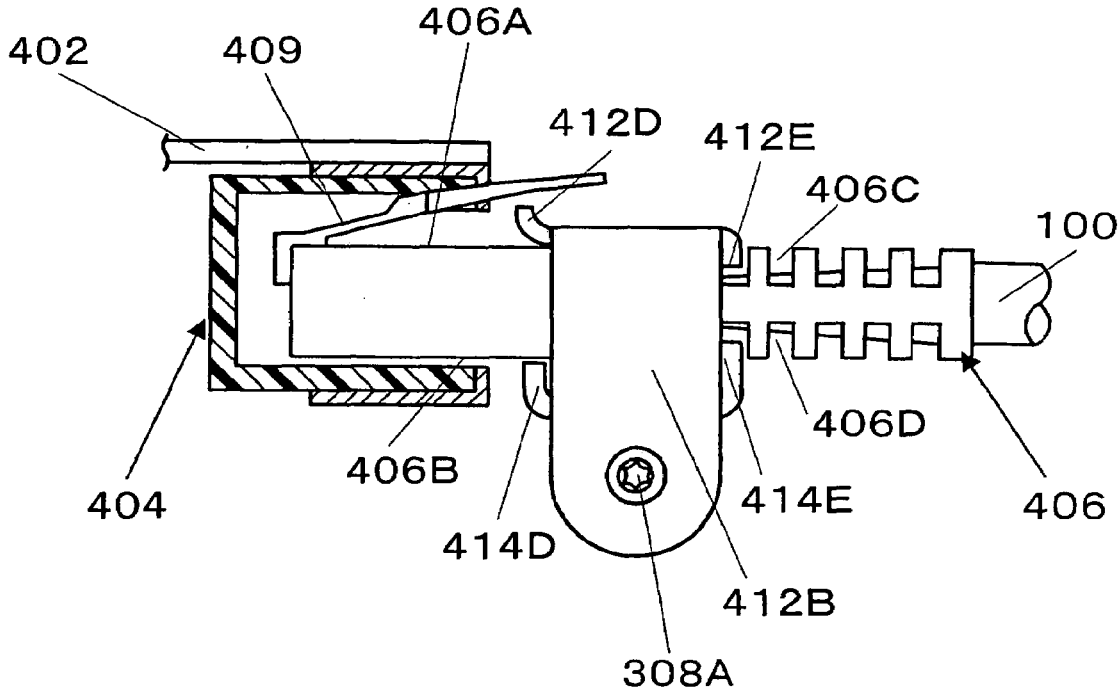
FIG. 36 is a partially sectional view showing a connector which is inserted in a socket and locked by the lock assembly illustrated in FIG. 35.

With reference to FIGS. 35 to 39, a lock assembly according to a fourth embodiment of the present invention will be described in detail. FIG. 35 is a perspective view showing the lock assembly according to the fourth embodiment, wherein FIG. 35(*a*) is a perspective view of the lock assembly, viewing from a certain direction, and FIG. 35(*b*) is a perspective view of the lock assembly, viewing from a direction opposite to that in FIG. 35(*a*). FIG. 36 is a partially sectional view showing a connector which is inserted in a socket and locked by the lock assembly according to the fourth embodiment As shown in FIGS. 35 and 36, the lock assembly 410 comprises a first encircling member 412 and a second encircling member 414. This lock assembly 410 is designed to be attached to a LAN-cable connector (hereinafter referred to simply as "connector") 406 so as to lock the connector 406 at an inserted position in a socket 404 of a hub 402.

Specifically, the lock assembly 410 is attached to the connector 406, and fastened by a set screw 308 so as to lock the connector 406 inserted in the socket 404, relative to the socket 404. Further, the set screw 308 is taken out to allow he lock assembly 410 to be detached from the connector 406 so as to allow the connector 406 to be pulled out of or removed from the socket 404. That is, the lock assembly 410 is operable to lock the connector 406 at the inserted position in the socket 404 so as to prohibit the connector 406 from being moved from a PC and thereby prevent theft of the PC.

With reference to FIGS. 35(*a*) and 35(*b*), the lock assembly 410 will be described in detail below. The second encircling member 414 is attached to be superimposed on an inner upper portion of the first encircling member 412 (the term "upper" means the upper side in figures). In the first encircling member 412, a first upright wall 412B and a second upright wall 412C stand upright, respectively, from opposite ends of a bottom wall 412A. A first upright wall 414B and a second upright wall 414 C standing upright, respectively, from opposite ends of a bottom wall 414A of the second encircling member 414, are disposed inside, respectively, the first upright wall 412B and the second upright wall 412C, in a superimposed manner. A protrusion finger 412G at an upper end of the second upright wall 412C of the first encircling member 412 is fitted into and fixed to a through-hole 414G formed in the second upright wall 414 C of the second encircling member 414. A position of a loose hole formed in the first upright wall 412B of the first encircling member 412 is aligned with a position of a screw hole formed in the first upright wall 414B of the second encircling member 414. Thus, the set screw 308 can be inserted from the side of the loose hole to the screw hole to fasten the first encircling member 412 and the second encircling member 414 together. A screw head 308A is formed with a groove for allowing a tool to be inserted thereto so as to drive the screw. A threaded portion 308B is a shank of the screw 308, and a thread is formed at a constant pitch.

With reference to FIG. 36, the lock assembly 410 will be described in detail below. FIG. 36 is a partially sectional view of the lock assembly 410 comprising the first encircling member 412 and the second encircling member 414 attached to the connector 406, viewing from the side of the upright wall 412B. In a state after the connector 406 is inserted into the socket 404, the bottom wall 412A of the first encircling member 412 is brought into contact with a top surface 406A the connector 406. In this state, a first engagement finger 412 E of the first encircling member 412 is fitted into one of a number of grooves 406C in a proximal end region of the connector 406. Further, a restriction finger 412D of the first encircling member 412 is inserted below a latching-flap 409 of the connector 406. The second encircling member 414 is attached such that the protrusion finger 412G at the upper end of the second upright wall 412C of the first encircling member 412 is fitted into the through-hole 414G formed in the second upright wall 412C of the second encircling member 414, and a second engagement finger 414E of the second encircling member 414 is fitted into one of a number of bottom grooves 406D of the proximal end region of the connector 406.

In this state, as shown in FIG. 36, the first encircling member 412 and the second encircling member 414 constituting the lock assembly 410 are fastened together by the set screw 408 to lock the connector 406 inserted into the socket 404. As shown in FIG. 35(*b*), each of the first engagement finger 412E of the first encircling member 412 and the second engagement finger 414E of the second encircling member 414 has a plurality of protrusions. The plurality of protrusions are designed to sandwich the respective upper grooves 406C and the respective bottom grooves 406D in the proximal end region of the LAN-cable connector 406 therebetween.

Figure 37:
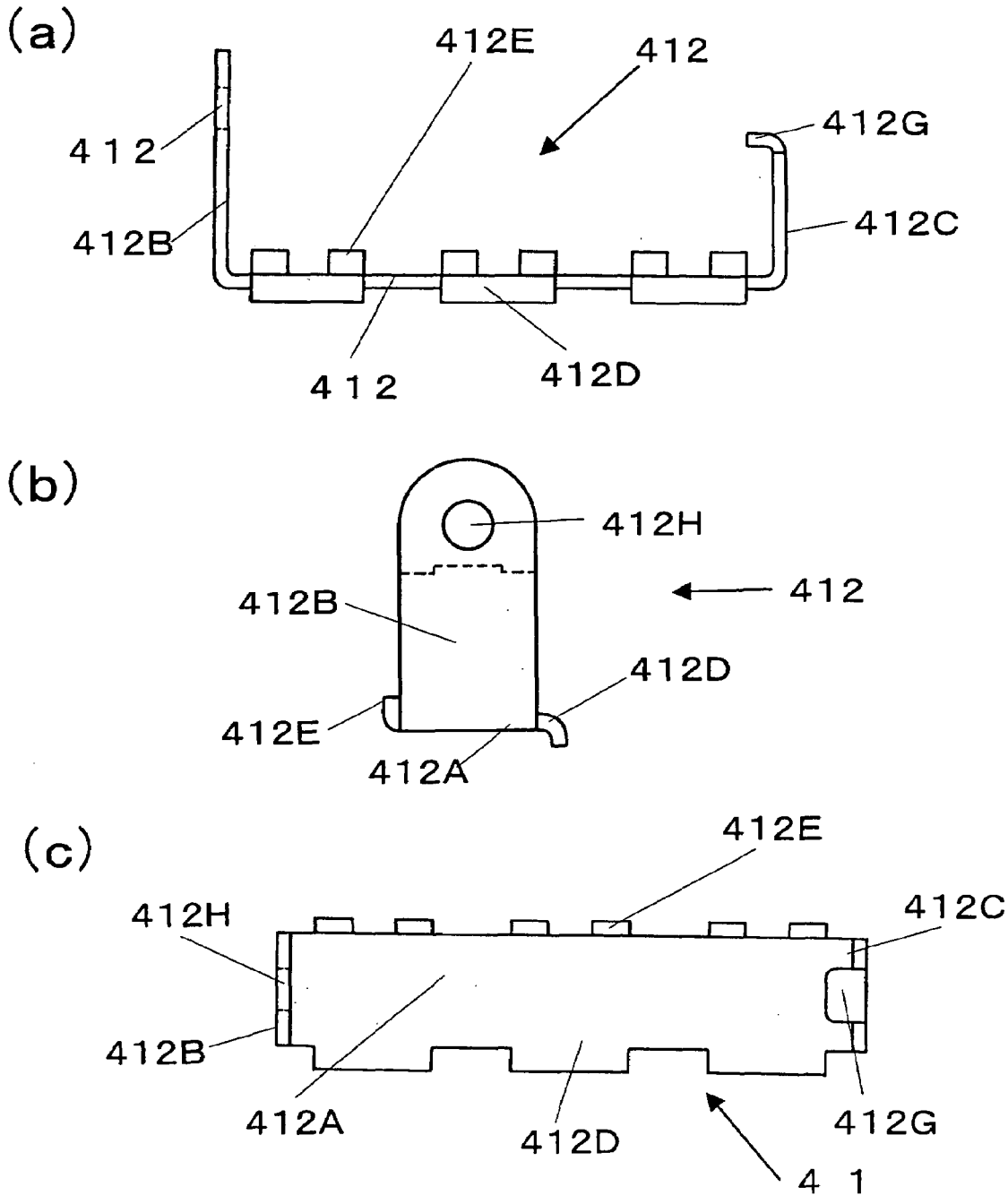
FIG. 37 illustrates a first encircling member of the lock assembly illustrated in FIG. 35.

FIG. 37 shows the detail of a shape of the first encircling member 412, wherein FIGS. 37(*a*), 37(*b*) and 37(*c*) are, respectively, a front view, a side view and a top plan view of the first encircling member 412. The first encircling member 412 integrally has the bottom wall 412A adapted to come into contact with the top surface 406A of the connector 406, the first upright wall 412B standing upright from a first one of axially-extending laterally opposed edges of the bottom wall 412A, the second upright wall 412C standing upright from the other or second edge of the bottom wall 412A, the third upright wall 412E standing upright from a rear edge of the bottom wall 412A extending in a direction orthogonal to the axial direction, and the restriction finger 412D standing upright from a front edge of the bottom wall 412A extending in a direction orthogonal to the axial direction. The protrusion finger 412G is formed at the upper end of the second upright wall 421C. The restriction finger 412D is provided in a number of three and attached to be inserted below the latching-flap 409 of the connector 406. The loose hole 312H is formed in the first upright wall 412B to allow the set screw 308 to penetrate therethrough. This loose hole 312H is a hole for allowing the set screw to loosely pass therethrough, and therefore formed to have a diameter slightly greater than the threaded portion 308B of the set screw 308.

The first engagement finger 412E is provided in a number of three. In a state after the lock assembly member 410 is attached to the connector 406, the first engagement finger 412E is fitted into and engaged with the upper groove 406C formed in a rear region of the connector 406. The first engagement finger 412E engaged with the upper groove 406C prohibits the first encircling member 412 (or the entire lock assembly 410) from being moved in the axial direction. The first engagement finger 412E has six protrusions designed to sandwich the upper groove 406C in the proximal end region of each of three LAN-cable connectors 406 therebetween.

Figure 38:
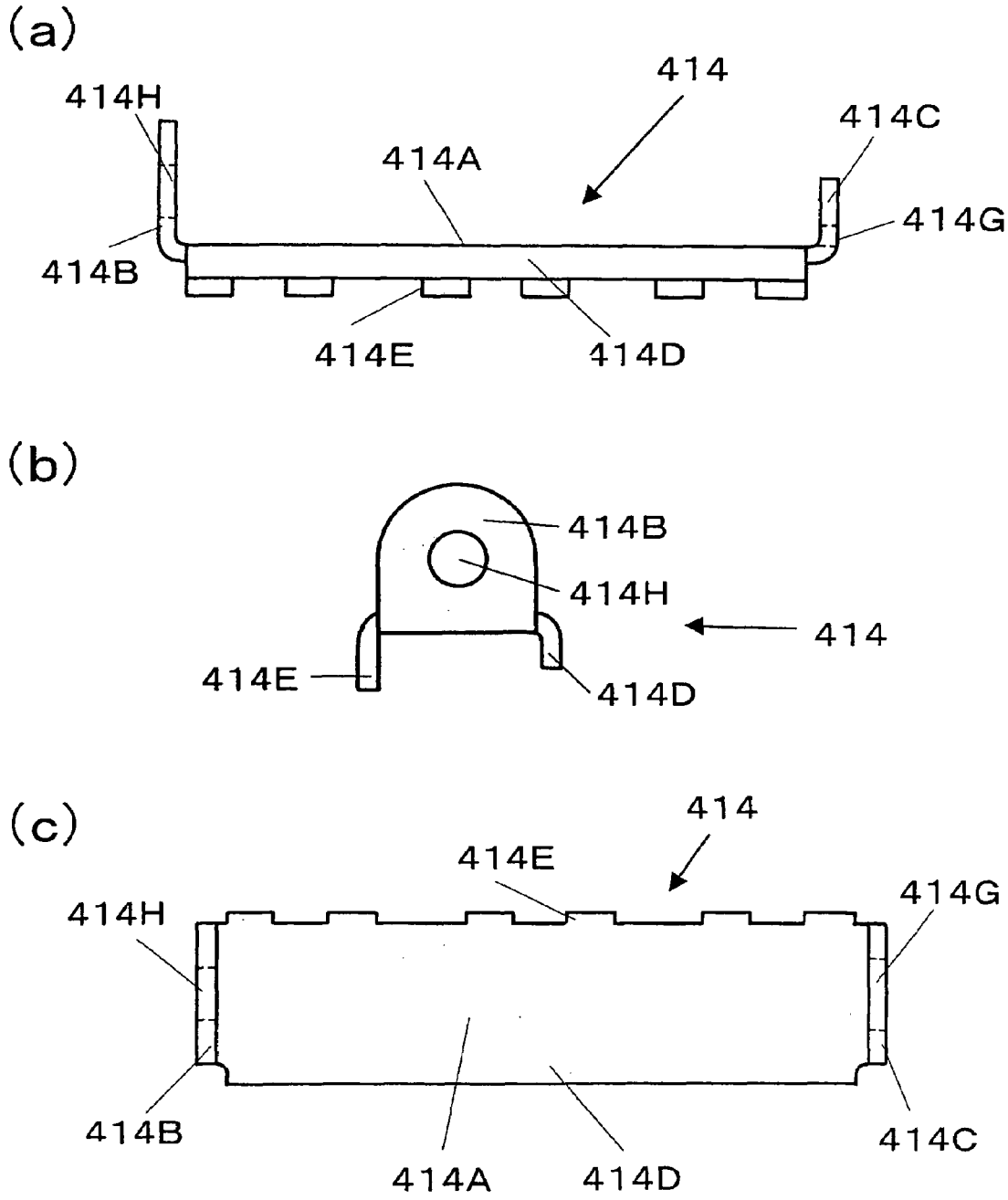
FIG. 38 illustrates a second encircling member of the lock assembly illustrated in FIG. 35.

FIG. 38 shows the detail of a shape of the second encircling member 414, wherein FIGS. 38(*a*), 38(*b*) and 38(*c*) are, respectively, a front view, a side view and a top plan view of the second encircling member 414. The second encircling member 414 integrally has the bottom wall 414A, the first upright wall 414B standing upright from one edge of the bottom wall 414A, the second upright wall 414C standing upright from another edge of the bottom wall 414A, the second engagement finger 414E standing upward from a front edge of the bottom wall 414A, and a pressing finger 414D extending from an edge on the opposite side of the bottom wall 414A. The second engagement finger 414E has six protrusions designed to sandwich the bottom groove 406D in the proximal end region of each of three LAN-cable connectors 406 therebetween. The pressing finger 414D is designed to protrude and come into contact with a bottom surface 406B of the connector 406. The first upright wall 414B is formed with the screw hole 414H adapted to be threadingly engaged with the set screw 308. This screw hole 414H is a hole for being engaged with the set screw 308 after penetrating the loose hole 412H of the first encircling member 412, and internally threaded in conformity to a thread pitch of the threaded portion 408B. The second upright wall 314C is formed with the through-hole 314G.

Figure 39:
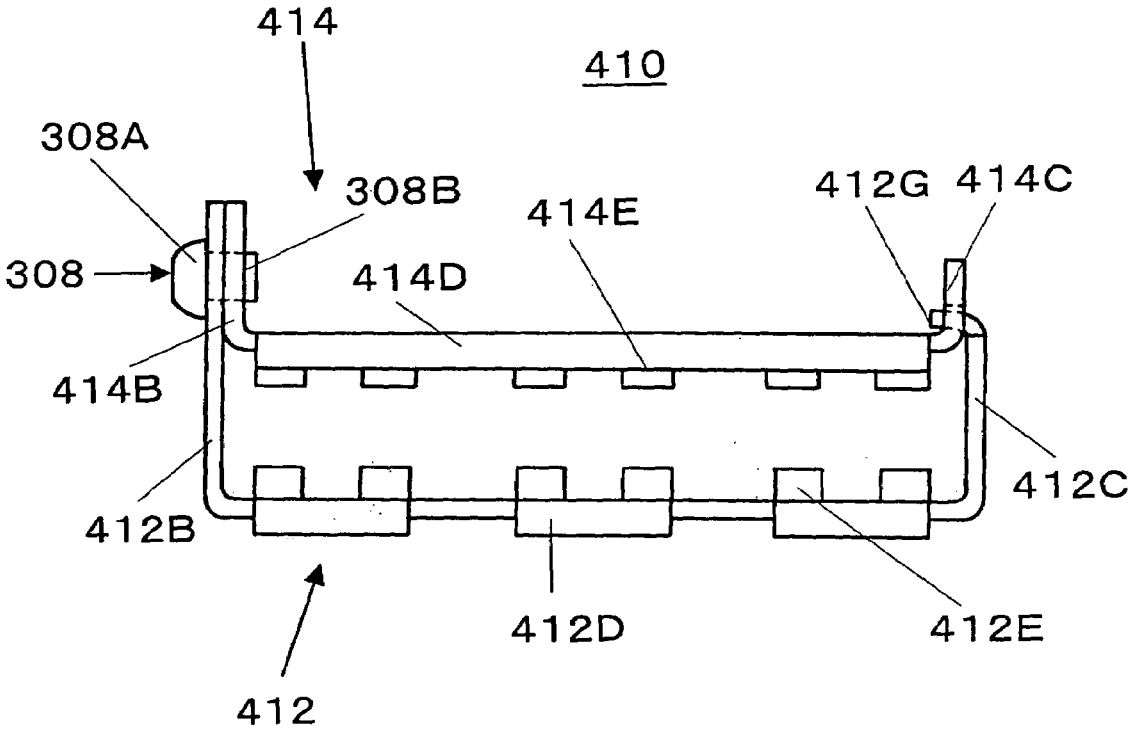
FIG. 39 is a top plan view showing the first and second encircling members after being assembled together.

With reference to FIG. 39, a process of assembling the first and second encircling members 412, 414 together will be described below.

FIG. 39 is a front view of the first encircling member 412 and the second encircling member 414 assembled together. The second encircling member 414 is attached to the first encircling member 412 from above in such a manner that respective upright walls of the first and second encircling members 412, 414 are partly superimposed on each other. Specifically, the protrusion finger 412G of the second upright wall 412C of the first encircling member 412 is fitted into the through-hole 414G of the second upright wall 414C of the second encircling member 414. Then, the loose hole 412H of the first upright wall 412B of the first encircling member 412 is arranged at the same position as that of the screw hole 414H of the first upright wall 414B of the second encircling member 414, and the first upright wall 412B of the first encircling member 412 and the first upright wall 414B of the second encircling member 414 are fastened and assembled together using the set screw 308.

Then, the lock assembly 410 is attached such that, in a state after the connector 406 is inserted into the sockets 404, the first and second upright walls 412B, 412C of the first encircling member 412 are located under the connector 406 so as to allow the bottom wall 412A of the first encircling member 412 to be brought into contact with the top surface 406A of the connector 406. In this state, the first engagement finger 412E of the first encircling member 412 is fitted into the upper groove 406C in the proximal end region of the connector 406, and the second engagement finger 414E of the second encircling member 414 is fitted into the bottom groove 406D in the proximal end region of the connector 406. Further, in the state after the connector 406 is inserted into the socket 404, the restriction finger 412D is inserted below the latching-flap 410.

In the lock assembly 410 attached in the above manner, the first upright wall 412B of the first encircling member 412 and the first upright wall 414B of the second encircling member 414 are fastened together using the set screw 308, and thereby the connector 406 inserted in the socket 404 is locked.

As mentioned above detail, the lock assembly 410 according to the fourth embodiment has the same effects as those the second embodiment. Further, the protrusion finger 214E in the second embodiment is improved as in the restriction finger 412D in the fourth embodiment to achieve downsizing. Furthermore, in the fourth embodiment, one set screw 308 is employed in place of the two locks 208, 209 in the second embodiment to facilitate downsizing, and formed as a special screw incapable of being handled using a normal tool so as to achieve antitheft effect. Thus, the lock assembly 310 is highly advantageous.

It is understood that the present invention is not limited to the above embodiment, but various modifications and changes may be made therein without departing from spirit and scope of the invention.

For example, while the number of LAN-cable connectors in the fourth embodiment is three, it is understood that the present invention is not limited such a number.

Fifth Embodiment

Figure 40:
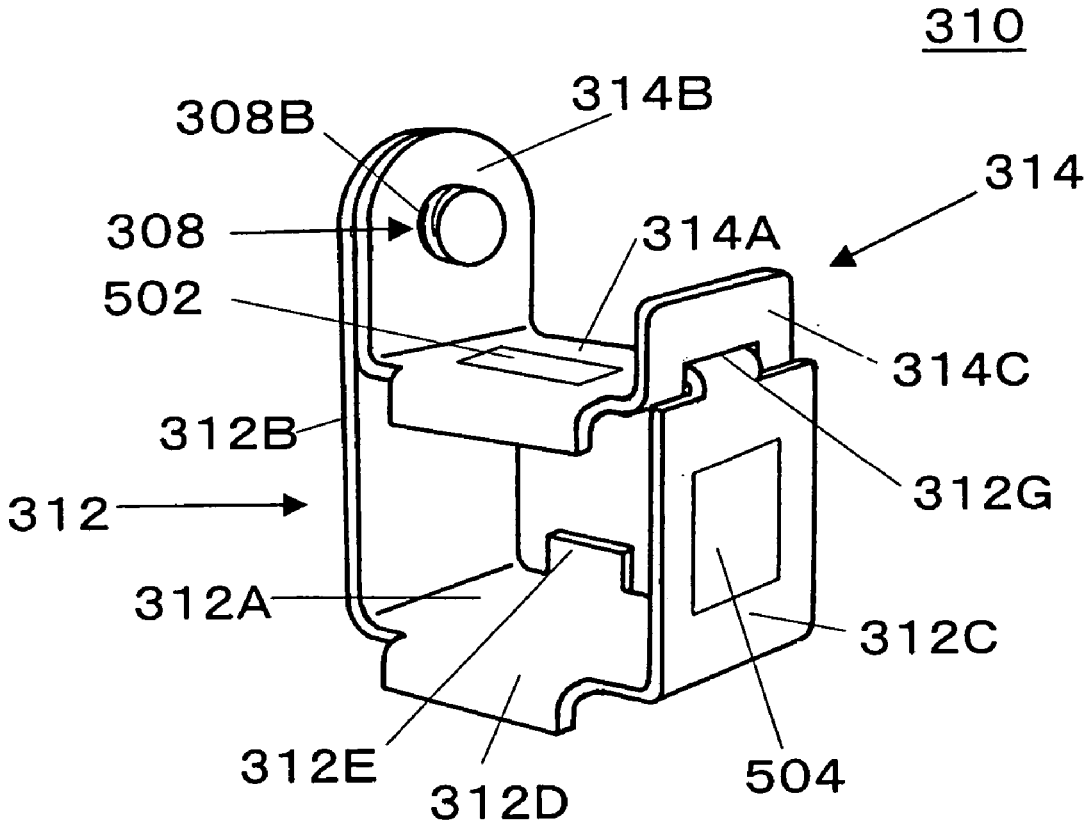
FIG. 40 is a perspective view showing a lock assembly according to a fifth embodiment of the present invention, viewing from a second upright wall of a first encircling member thereof.
Figure 41:
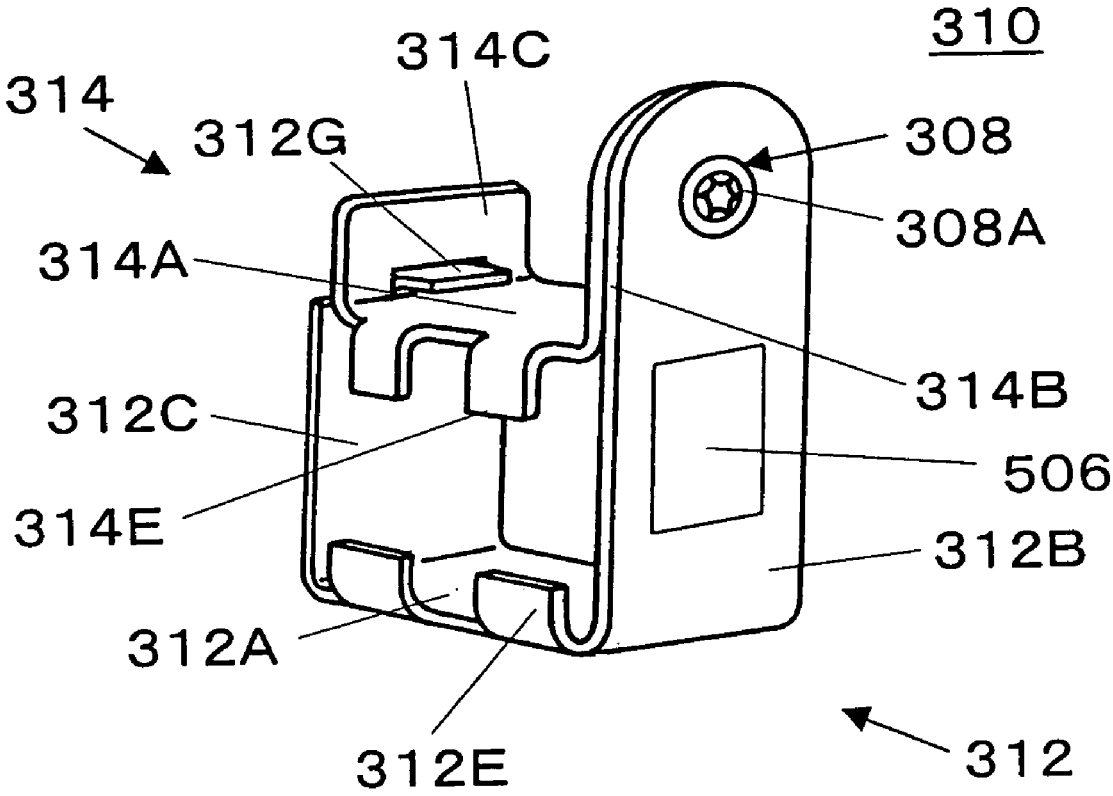
FIG. 41 is a perspective view showing the lock assembly illustrated in FIG. 40, viewing from a first upright wall of the first encircling member.
Figure 42:
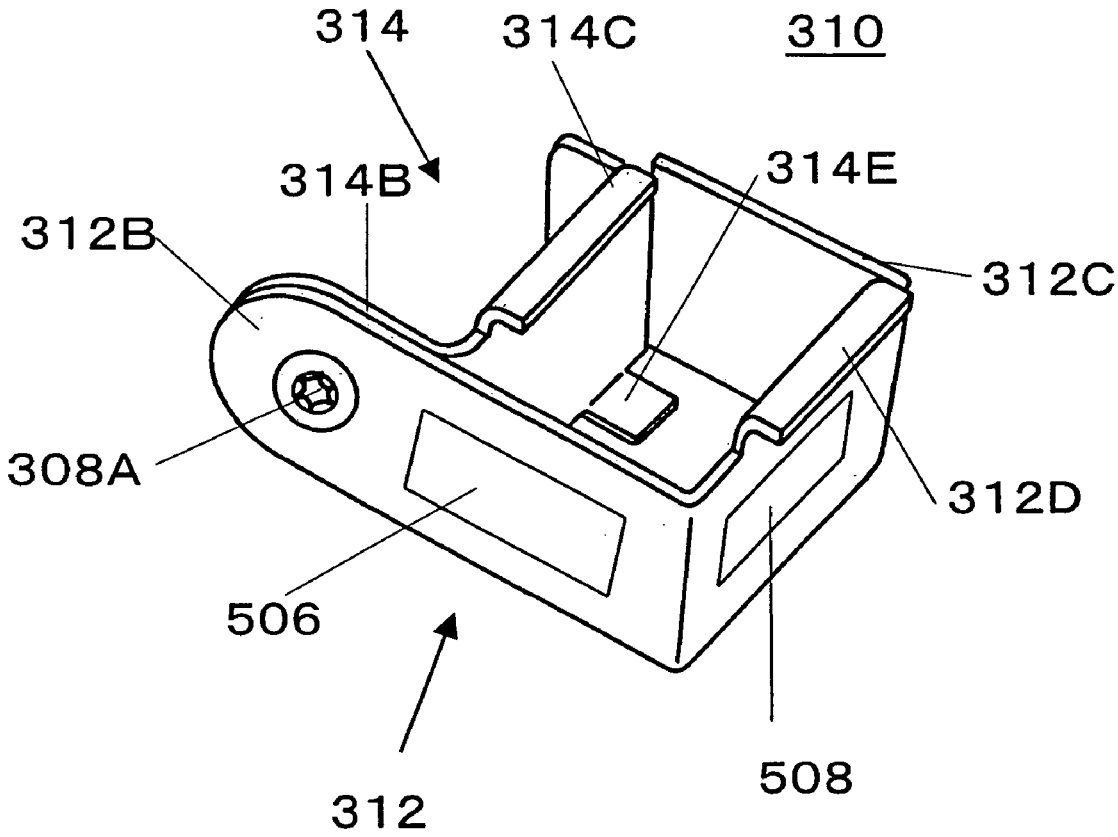
FIG. 42 is a perspective view showing the lock assembly illustrated in FIG. 40, viewing from a bottom wall of the first encircling member.

With reference to FIGS. 40 to 42, a lock assembly according to a fifth embodiment of the present invention will be described in detail. In these figures, the same component or element as that in the third embodiment is defined by the same reference numeral, and its description will be omitted.

FIGS. 40 to 42 are perspective views showing the lock assembly 310 according to the fifth embodiment, wherein: FIG. 40 is a perspective view showing the lock assembly, viewing from a second upright wall 312C of a first encircling member 312 thereof; FIG. 41 is a perspective view showing the lock assembly, viewing from a first upright wall 312B of the first encircling member 312; and FIG. 42 is a perspective view showing the lock assembly, viewing from a bottom wall 312A of the first encircling member 312.

The lock assembly 310 illustrated in FIGS. 40 to 42 is provided with distinguishing means for distinguishing a PC locked for antitheft. This is provided as a means to allow a plurality of PC maintenance staffs to quickly distinguish a LAN cable connected to a PC in his/her charge without fail so as to facilitate PC management with high efficiency.

In the fifth embodiment, as the distinguishing means, a color sticker is attached to the lock assembly 310. The color sticker may be selectively attached at any suitable position in consideration of convenience of PC maintenance staffs. For example, as shown in FIG. 40, it may be a color sticker 502 attached at a bottom wall 314A of a second encircling member 314, or a color sticker 504 attached at an outer surface of the second upright wall 312C of the first encircling member 312. Alternatively, it may be a color sticker 506 attached at an outer surface of the first upright wall 312B of the first encircling member 312, as shown in FIG.

41, or a color sticker 508 attached at a back surface of a bottom wall 314A of the first encircling member 312, as shown in FIG. 42.

In place of color stickers, as the distinguishing means, the lock assembly 310 may be colored. As a position to be colored, the entire lock assembly 310 may be colored, or only a position corresponding to the above sticker may be colored.

Sixth Embodiment

Figure 43:
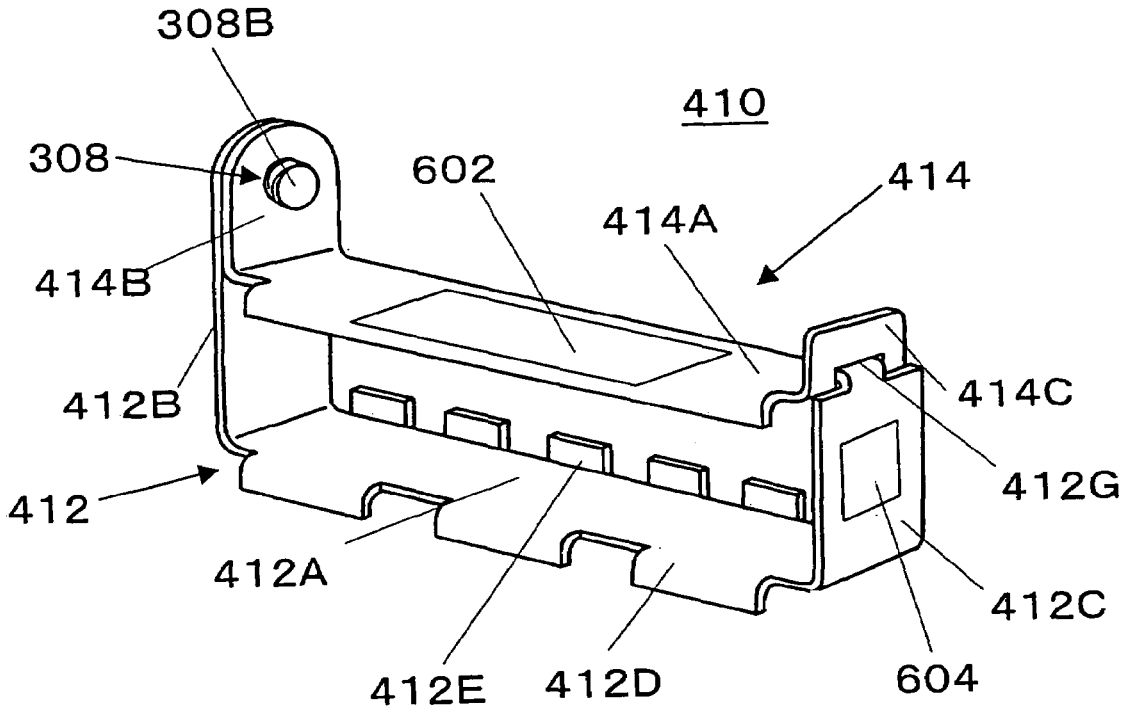
FIG. 43 is a perspective view showing a lock assembly according to a sixth embodiment of the present invention, viewing from a second upright wall of a first encircling member thereof.
Figure 44:
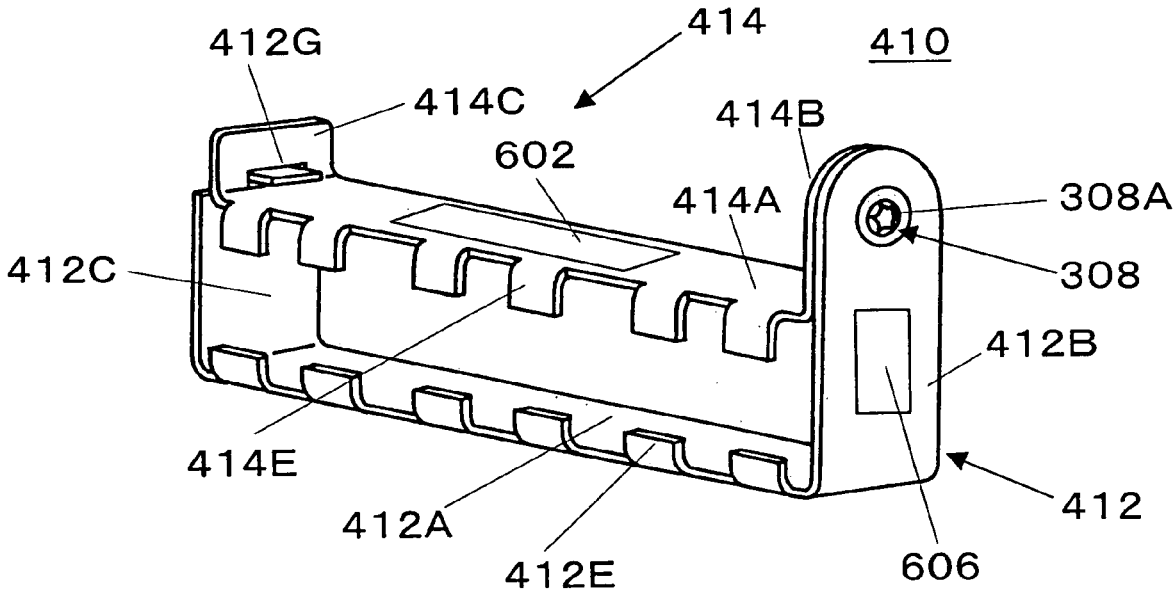
FIG. 44 is a perspective view showing the lock assembly illustrated in FIG. 43, viewing from a first upright wall of the first encircling member.
Figure 45:
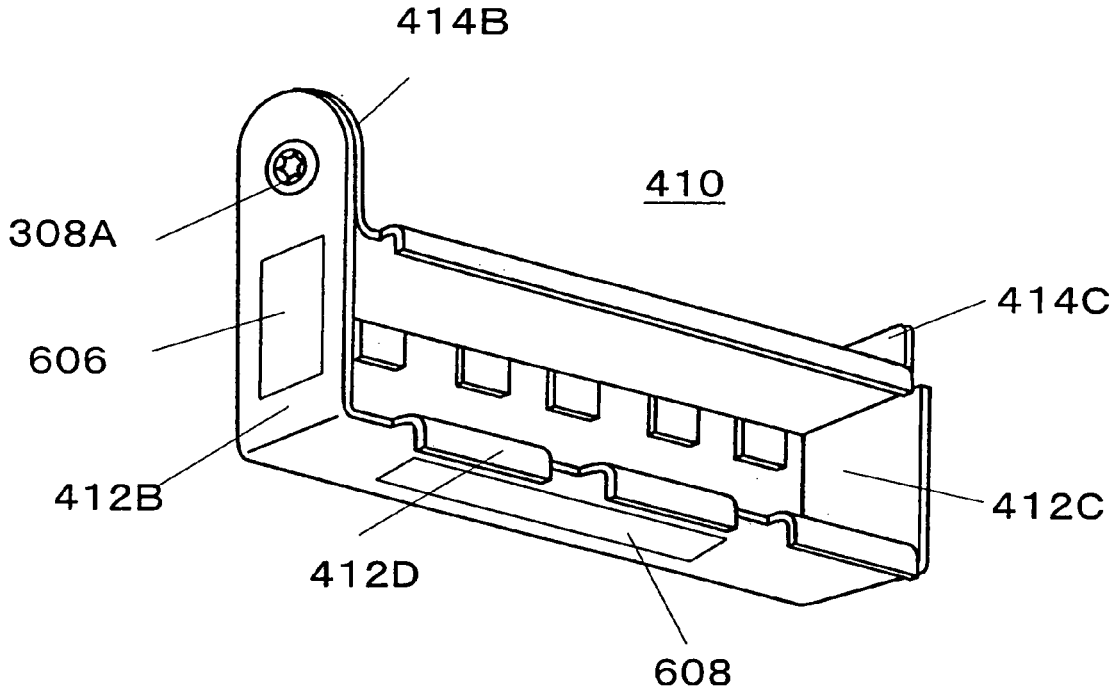
FIG. 45 is a perspective view showing the lock assembly illustrated in FIG. 43, viewing from a bottom wall of the first encircling member.

With reference to FIGS. 43 to 45, a lock assembly according to a sixth embodiment of the present invention will be described in detail. In these figures, the same component or element as that in the fourth embodiment is defined by the same reference numeral, and its description will be omitted.

FIGS. 43 to 45 are perspective views showing the lock assembly 410 according to the sixth embodiment, wherein: FIG. 43 is a perspective view showing the lock assembly, viewing from a second upright wall 412C of a first encircling member 412 thereof; FIG. 44 is a perspective view showing the lock assembly, viewing from a first upright wall 412B of the first encircling member 312; and FIG. 45 is a perspective view showing the lock assembly, viewing from a bottom wall 412A of the first encircling member 412.

The lock assembly 410 illustrated in FIGS. 43 to 45 is provided with distinguishing means for distinguishing a PC locked for antitheft. This is provided as a means to allow a plurality of PC maintenance staffs to quickly distinguish a LAN cable connected to a PC in his/her charge without fail so as to facilitate PC management with high efficiency.

In the sixth embodiment, as the distinguishing means, a color sticker is attached to the lock assembly 410. The color sticker may be selectively attached at any suitable position in consideration of convenience of PC maintenance staffs. For example, as shown in FIG. 43, it may be a color sticker 602 attached at a bottom wall 414A of a second encircling member 414, or a color sticker 604 attached at an outer surface of the second upright wall 412C of the first encircling member 412. Alternatively, it may be a color sticker 606 attached at an outer surface of the first upright wall 412B of the first encircling member 412, as shown in FIG. 44, or a color sticker 608 attached at a back surface of a bottom wall 414A of the first encircling member 412, as shown in FIG. 45.

In place of color stickers, as the distinguishing means, the lock assembly 410 may be colored. As a position to be colored, the entire lock assembly 410 may be colored, or only a position corresponding to the above sticker may be colored.

[Other Modification]

It is understood that the present invention is not limited to the above embodiments, but various modifications and changes may be made therein without departing from spirit and scope of the invention.

While the above fifth or sixth embodiment employs a color sticker or coloring of the lock assembly as the distinguishing means, the distinguishing means is not limited thereto. For example, as the distinguishing means, the special screw used as set screw in the third to sixth embodiments may be changed on a lock assembly-by-lock assembly basis. Further, a special screw different in type of screwing tool may be used. In this case, a PC maintenance staff can handle only a connector of a LAN cable connected to a PC in his/her charge. This provide an effect of being able to effectively prevent occurrence of troubles in intranet configuration due to attaching/detaching of LAN cables, and to allow a plurality of PC maintenance staffs to quickly distinguish a LAN cable connected to a PC in his/her charge without fail so as to facilitate PC management with high efficiency.

In addition to color stickers and coloring, character, mark, cord or combination thereof may be used as the distinguishing means.

INDUSTRIAL APPLICABILITY

As mentioned above in detail, the lock assembly of the present invention is an innovative PC antitheft technology as an alternative to the conventional coupling wire. The present intention is based on restrict attaching/detaching of a LAN cable connector for both PC and hub to effectively prevent occurrence of troubles due to attaching/detaching of the LAN cable.

This technique of restricting attaching/detaching of a LAN can protect from computer crimes (data theft, unlawful computer access), and contribute to improvement in security of local area network or intranet. The present invention has high usability as a security enhancement device. In addition to PC antitheft effect and effect of preventing troubles in intranet, the present invention has specific usability as a network security device, such as prohibition of connection to other network or protection against private access to a server due to improper PC connection.

What is claimed is:

1. A lock assembly adapted to be detachably attached to a LAN-cable connector which is integrally fixed to a LAN cable and adapted to be removably inserted into a socket and latched at an inserted position thereof, said lock assembly being operable, when attached to the LAN-cable connector, to allow said LAN-cable connector after being inserted into said socket to be locked at said inserted position, and, when detached from said LAN-cable connector, to allow said LAN-cable connector to be removed from said socket, said lock assembly comprising:

first and second encircling members adapted to be separatably assembled together along a circumferential direction and to be attached to the LAN-cable connector in such a manner as to encircle an outer periphery of said LAN-cable connector substantially in close contact therewith;

engagement means formed in said first encircling member and adapted to, in a state after said first and second encircling members are attached to the LAN-cable connector in such a manner as to encircle the outer periphery of said LAN-cable connector, prevent said first encircling member from being moved relative to said LAN-cable connector in an axial direction of said LAN-cable connector; and restriction means formed in said second encircling member and adapted to, in the state after said first and second encircling members are attached to the LAN-cable connector in such a manner as to encircle the outer periphery of said LAN-cable connector, restrict a latching-flap fixed to said LAN-cable connector from being moved in a latch-release direction.

2. The lock assembly as defined in claim 1, wherein:

either one of said first and second encircling members is formed to cover three of four surfaces defining the outer periphery of said LAN-cable connector; and the other encircling member is formed to cover a remaining one of the four surfaces defining the outer periphery of said LAN-cable connector.

3. The lock assembly as defined in claim 1, wherein:

said first encircling member is formed to cover three of four surfaces defining the outer periphery of said LAN-cable connector; and said second encircling member is formed to cover a remaining one of the four surfaces defining the outer periphery of said LAN-cable connector.

4. The lock assembly as defined in claim 1, wherein said engagement means includes an engagement protrusion engageable with a groove formed in at least one of a plurality of surfaces of the LAN-cable connector except for one of said surfaces having said latching-flap.

5. The lock assembly as defined in claim 4, wherein said surface formed with said groove in the surfaces of said LAN-cable connector is located on the opposite side of said surface having said latching-flap.

6. The lock assembly as defined in claim 1, wherein:

said latching-flap is designed to release its latching state when it is pressed down toward a surface of said LAN-cable connector having said latching-flap; and said restriction means includes a restriction finger designed to, in the state after said first and second encircling members are attached to the LAN-cable connector in such a manner as to encircle the outer periphery of said LAN-cable connector, extend from said second encircling member to a position adjacent to an anchor end of said latching-flap so as to restrict said latching-flap from being pressingly moved downward.

7. The lock assembly as defined in claim 1, which includes a lock adapted to be locked so as to unseparatably connect said first and second encircling members to one another and to be unlocked so as to allow said first and second encircling members to be separated from one another.

8. The lock assembly as defined in claim 7, wherein said first and second encircling members include first and second portions superimposable on one another, respectively, in the state after said first and second encircling members are attached to the LAN-cable connector in such a manner as to encircle the outer periphery of said LAN-cable connector, said first and second superimposable portions being formed, respectively, with first and second lock holes adapted to be aligned with one another in such a manner as to allow a lock rod of said lock to continuously penetrate therethrough.

9. The lock assembly as defined in claim 1, which includes a special screw adapted to be attached to said first and second encircling members so as to unseparatably connect said first and second encircling members to one another and to be detached from said first and second encircling members so as to allow said first and second encircling members to be separated from one another.

10. The lock assembly as defined in claim 9, wherein said first and second encircling members include first and second portions superimposable on one another, respectively, in the state after said first and second encircling members are attached to the LAN-cable connector in such a manner as to encircle the outer periphery of said LAN-cable connector, either one of said first and second superimposable portions being formed with a loose hole for allowing an externally threaded shank of said special screw to loosely penetrate therethrough, the other superimposable portion being formed with an internally threaded hole engageable with said externally threaded shank.

11. A lock assembly adapted to be detachably attached to a plurality of LAN-cable connectors each of which is integrally fixed to a corresponding one of a plurality of LAN cables and adapted to be removably inserted into a corresponding one of a plurality of sockets and latched at an inserted position thereof, said lock assembly being operable, when attached to the plurality of LAN-cable connectors, to allow said plurality of LAN-cable connectors after being inserted into said corresponding sockets to be locked at said respective inserted positions, and, when detached from said plurality of LAN-cable connectors, to allow said plurality of LAN-cable connectors to be removed from said corresponding sockets, said lock assembly comprising:

first and second encircling members adapted to be separatably assembled together along an outer periphery surrounding said plurality of LAN-cable connectors and to be attached to the plurality of LAN-cable connectors in such a manner as to clamp the outer periphery surrounding said plurality of LAN-cable connectors substantially in close contact therewith;

engagement means formed in said first encircling member and adapted to, in a state after said first and second encircling members are attached to the plurality of LAN-cable connectors in such a manner as to encircle the outer periphery surrounding said plurality of LAN-cable connectors, prevent said first encircling member from being moved relative to said plurality of LAN-cable connectors in an axial direction of each of said plurality of LAN-cable connectors; and restriction means formed in said second encircling member and adapted to, in the state after said first and second encircling members are attached to the plurality of LAN-cable connectors in such a manner as to encircle the outer periphery surrounding said plurality of LAN-cable connectors, restrict a latching-flap fixed to each of said plurality of LAN-cable connectors from being moved in a latch-release direction.

12. The lock assembly as defined in claim 11, wherein:

either one of said first and second encircling members is formed to cover three of four surfaces defining said outer periphery surrounding said plurality of LAN-cable connectors; and the other encircling member is formed to cover a remaining one of the four surfaces defining said outer periphery surrounding said plurality of LAN-cable connectors.

13. The lock assembly as defined in claim 11, wherein:

said first encircling member is formed to cover three of four surfaces defining said outer periphery surrounding said plurality of LAN-cable connectors; and said second encircling member is formed to cover a remaining one of the four surfaces defining said outer periphery surrounding said plurality of LAN-cable connectors.

14. The lock assembly as defined in claim 11, wherein said engagement means includes a plurality of engagement protrusions each engageable with a groove formed in at least one of a plurality of surfaces of a corresponding one of said plurality of LAN-cable connectors, except for one of said surfaces having said latching-flap.

15. The lock assembly as defined in claim 14, wherein said surface formed with said groove in each of said plurality of LAN-cable connectors is located on the opposite side of said surface having said latching-flap.

16. The lock assembly as defined in claim 11, wherein:

said latching-flap in each of the plurality of LAN-cable connectors is designed to release its latching state when it is pressed down toward a surface of said LAN-cable connector provided therewith; and said restriction means includes a restriction finger designed to, in the state after said first and second encircling members are attached to the plurality of LAN-cable connectors in such a manner as to encircle the outer periphery surrounding said plurality of LAN-cable connector, extend from said second encircling member to a position adjacent to an anchor end of said latching-flap so as to restrict said latching-flap from being pressingly moved downward.

17. The lock assembly as defined in claim 11, which includes a lock adapted to be locked so as to unseparatably connect said first and second encircling members to one another and to be unlocked so as to allow said first and second encircling members to be separated from one another.

18. The lock assembly as defined in claim 17, wherein said first and second encircling members include first and second portions superimposable on one another, respectively, in the state after said first and second encircling members are attached to the plurality of LAN-cable connectors in such a manner as to encircle the outer periphery surrounding said plurality of LAN-cable connectors, said first and second superimposable portions being formed, respectively, with first and second lock holes adapted to be aligned with one another in such a manner as to allow a lock rod of said lock to continuously penetrate therethrough.

19. The lock assembly as defined in claim 11, which includes a special screw adapted to be attached to said first and second encircling members so as to unseparatably connect said first and second encircling members to one another and to be detached from said first and second encircling members so as to allow said first and second encircling members to be separated from one another.

20. The lock assembly as defined in claim 19, wherein said first and second encircling members include first and second portions superimposable on one another, respectively, in the state after said first and second encircling members are attached to the plurality of LAN-cable connectors in such a manner as to encircle the outer periphery surrounding said plurality of LAN-cable connectors, either one of said first and second superimposable portions being formed with a loose hole for allowing an externally threaded shank of said special screw to loosely penetrate therethrough, the other superimposable portion being formed with an internally threaded hole engageable with said externally threaded shank.

21. The lock assembly as defined in claim 1 or 11, wherein said first and second encircling members are assembled to define four surfaces, at least one of said surfaces having distinguishing means.

22. The lock assembly as defined in claim 21, wherein said distinguishing means includes a color sticker.

23. The lock assembly as defined in claim 1 or 11, wherein said first and second encircling members are assembled to define four surfaces, at least one of said surfaces being colored.

* * * * *